US010905256B2

(12) United States Patent
Johnson et al.

(10) Patent No.: US 10,905,256 B2
(45) **Date of Patent: *Feb. 2, 2021**

(54) MULTI-CHUTE GRAVITY FEED DISPENSER DISPLAY

(71) Applicant: Gamon Plus, Inc., Chicago, IL (US)

(72) Inventors: Terry J. Johnson, Chicago, IL (US); Travis Ogden Johnson, Chicago, IL (US); John Schoemer, Myrtle Beach, SC (US)

(73) Assignee: Gamon Plus, Inc., Bensenville, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/215,617

(22) Filed: Dec. 10, 2018

(65) Prior Publication Data

US 2019/0274449 A1 Sep. 12, 2019

Related U.S. Application Data

(63) Continuation of application No. 14/861,017, filed on Sep. 22, 2015, now Pat. No. 10,149,554, which is a continuation of application No. 14/459,600, filed on Aug. 14, 2014, now Pat. No. 9,144,326, which is a continuation of application No. 11/164,784, filed on Dec. 6, 2005, now Pat. No. 8,827,111, which is a (Continued)

(51) Int. Cl.

| | |
|---|---|
| ***A47F 1/12*** | (2006.01) |
| ***A47F 7/28*** | (2006.01) |
| ***A47F 7/00*** | (2006.01) |
| ***A47F 5/00*** | (2006.01) |
| ***A47F 3/02*** | (2006.01) |
| ***A47F 1/08*** | (2006.01) |

(52) U.S. Cl.

CPC ..... *A47F 1/12* (2013.01); *A47F 1/087* (2013.01); *A47F 3/02* (2013.01); *A47F 5/0018* (2013.01); *A47F 7/0007* (2013.01); *A47F 7/0035* (2013.01); *A47F 7/28* (2013.01); *A47F 1/08* (2013.01)

(58) Field of Classification Search

CPC .... A47F 1/12; A47F 1/08; A47F 1/087; A47F 3/02; A47F 5/0018; A47F 7/0007; A47F 7/0028; A47F 7/0035; A47F 7/28

USPC ..... 221/194

See application file for complete search history.

(56) References Cited

U.S. PATENT DOCUMENTS

| | | | |
|---|---|---|---|
| 107,753 | A | 9/1870 | Belding |
| 231,027 | A | 8/1880 | Fitch |

(Continued)

FOREIGN PATENT DOCUMENTS

| | | | |
|---|---|---|---|
| DE | G 90 03 964.5 | U1 | 7/1990 |
| EP | 0490693 | A2 | 6/1992 |

(Continued)

OTHER PUBLICATIONS

Photographs (5) of Gamon International's can dispenser display, 1997.

(Continued)

*Primary Examiner* — Michael Collins

(74) *Attorney, Agent, or Firm* — Tiajoloff & Kelly LLP

(57) ABSTRACT

A set of panels having chutes therebetween. The chutes being defined by curvilinear rails on such panels. The curvilinear rails having stops thereon for stopping the products for viewing.

15 Claims, 26 Drawing Sheets

Related U.S. Application Data continuation-in-part of application No. 10/600,387, filed on Jun. 20, 2003, now Pat. No. 6,991,116.

(60) Provisional application No. 60/404,648, filed on Aug. 20, 2002.

(56) References Cited

U.S. PATENT DOCUMENTS 265,400 A 10/1882 Fitch
514,948 A 2/1894 Luster
533,963 A * 2/1895 Nortcutt ..... A47F 1/08 221/92
667,081 A 1/1901 Gentner
1,008,429 A 11/1911 Osmer
1,015,926 A 1/1912 Anderson
1,023,116 A 4/1912 Bailey
1,170,667 A 2/1916 Peterson
1,596,206 A 2/1926 Mayer
1,694,897 A 8/1927 Washburn
1,995,040 A 1/1933 Pietzsch et al.
1,999,021 A 4/1935 Marsh
2,150,469 A 3/1939 Tozer et al.
2,222,690 A 11/1940 Shank
2,339,383 A 1/1944 Davidson
2,382,191 A 8/1945 Weichselbaum
2,443,871 A * 6/1948 Shield ..... A47F 7/285 211/59.2
2,467,411 A 4/1949 Tingdale
2,562,015 A 7/1951 Cattanach
D178,248 S 7/1956 Knott et al.
2,755,965 A 7/1956 Ringler
2,770,898 A 11/1956 Lutz et al.
2,852,237 A 9/1958 Mason
2,852,327 A 9/1958 Mason
2,888,145 A 5/1959 Knott et al.
2,928,539 A 3/1960 Chirchiglia
2,996,344 A 8/1961 Garman et al.
3,055,293 A 9/1962 Lariccia
D198,295 S 5/1964 Di Domenico et al.
D198,888 S 8/1964 Heselov
D198,889 S 8/1964 Heselov
3,152,695 A 10/1964 Stewart, Jr.
3,152,697 A 10/1964 Berman
3,178,242 A 4/1965 Ellis et al.
3,194,476 A 7/1965 Weiss
3,194,620 A 7/1965 Sauer
3,203,554 A 8/1965 Prendergrast, Jr. et al.
3,298,513 A 1/1967 Krooss et al.
3,298,763 A 1/1967 DiDomenico
3,304,141 A 2/1967 Rogers
3,306,688 A 2/1967 DiDomenico
3,318,455 A 5/1967 Takahashi
3,351,209 A 11/1967 Kofoed et al.
3,395,809 A 8/1968 Mellion
3,404,927 A 11/1968 Mellion
3,456,420 A 7/1969 Ganz
3,478,456 A 11/1969 Mundt et al.
3,589,593 A 6/1971 Weiss
3,603,501 A 9/1971 Confer
3,743,137 A 7/1973 Bennett
3,784,022 A 1/1974 Beesley
3,923,159 A 12/1975 Taylor et al.
3,942,631 A 3/1976 Sutherland et al.
4,015,885 A 4/1977 Baggaley
4,105,126 A 8/1978 Deffner et al.
4,111,309 A 9/1978 Henry
4,200,220 A 4/1980 Ganz
4,217,711 A 8/1980 Spresser et al.
4,228,903 A 10/1980 Eckert
4,243,145 A 1/1981 Woodhead
4,274,580 A 6/1981 Arnold
4,356,923 A 11/1982 Young et al.
4,416,411 A 11/1983 Demond
4,426,008 A 1/1984 Olson et al.
4,456,147 A 6/1984 Tominaga
4,474,297 A 10/1984 Zucker
4,530,548 A 7/1985 Spamer et al.
4,598,828 A 7/1986 Young et al.
D290,790 S 7/1987 Nathan et al.
4,744,489 A 5/1988 Binder et al.
4,805,331 A 2/1989 Boggess et al.
4,823,984 A 4/1989 Ficken
4,871,068 A 10/1989 Dreyfus
4,909,578 A 3/1990 Abbate
4,911,309 A * 3/1990 Stefan ..... A47F 1/087 211/189
4,915,571 A 4/1990 Toshihiko et al.
4,974,771 A 12/1990 Lavery
4,997,106 A 3/1991 Rockola
5,094,347 A 3/1992 Schuster
5,125,505 A 6/1992 Kurosaki
5,199,598 A 4/1993 Sampson
5,228,590 A 7/1993 Blasko et al.
D342,420 S 12/1993 Ienna
5,289,943 A 3/1994 Powell
5,295,608 A 3/1994 Blasko et al.
5,356,033 A 10/1994 Delaney
5,372,416 A 12/1994 Shapley
D354,181 S 1/1995 Smith et al.
5,462,198 A * 10/1995 Schwimmer ..... G07F 11/34 221/130
D371,244 S 7/1996 Weshler
D380,113 S 6/1997 Byrd
5,645,176 A 7/1997 Jay
5,788,117 A 8/1998 Zimmanck
5,806,712 A 9/1998 Siemsen et al.
5,826,746 A 10/1998 Ash, Jr.
D405,622 S 2/1999 Linz
5,957,289 A 9/1999 Negelen
D417,975 S * 12/1999 Linz ..... D6/702
6,068,142 A 5/2000 Primiano
6,149,021 A 11/2000 Beaulieu
6,276,538 B1 8/2001 Battaglia et al.
6,283,293 B1 9/2001 Lingamfelter
D459,927 S 7/2002 Flowers et al.
6,484,903 B2 11/2002 Spivey et al.
6,554,159 B1 4/2003 Behr et al.
6,578,736 B2 6/2003 Spivey
6,637,604 B1 10/2003 Jay
D486,324 S 2/2004 Mason
6,729,057 B1 5/2004 Lu
6,786,341 B2 9/2004 Stinnett et al.
D499,590 S 12/2004 Meredith
D499,914 S 12/2004 Rimback
6,877,600 B2 4/2005 Sutherland
6,919,111 B2 7/2005 Swoboda et al.
D509,689 S 9/2005 Ho
6,991,116 B2 1/2006 Johnson et al.
7,083,054 B2 8/2006 Squitieri
7,104,435 B2 9/2006 Holley, Jr.
7,213,722 B2 5/2007 Nagelski et al.
D563,127 S 3/2008 Henry et al.
D572,057 S 7/2008 Lledo
D584,547 S 1/2009 Merrick et al.
D588,386 S 3/2009 Johnson et al.
7,523,842 B2 4/2009 Spivey
D595,074 S 6/2009 Johnson et al.
D608,575 S 1/2010 Johnson et al.
D612,646 S 3/2010 Johnson et al.
7,690,518 B2 4/2010 Fincher et al.
D621,644 S 8/2010 Johnson
D621,645 S 8/2010 Johnson
8,827,111 B2 * 9/2014 Johnson ..... A47F 1/087 221/124
9,144,326 B2 * 9/2015 Johnson ..... A47F 1/087
10,149,554 B2 * 12/2018 Johnson ..... A47F 1/087
2002/0073588 A1 6/2002 Reynolds et al.
2002/0185499 A1 12/2002 Harrelson et al.
2004/0011751 A1 1/2004 Johnson et al.
2005/0127015 A1 6/2005 Medcalf et al.
2006/0131320 A1 6/2006 Nagelski et al.
2008/0245813 A1 10/2008 Johnson et al.
2009/0090739 A1 4/2009 Merl

(56) References Cited

U.S. PATENT DOCUMENTS

| | | | |
|---|---|---|---|
| 2009/0212066 | A1 | 8/2009 | Bauer |
| 2009/0266776 | A1 | 10/2009 | Johnson |
| 2015/0014261 | A1 | 1/2015 | Johnson et al. |
| 2016/0007768 | A1 | 1/2016 | Johnson et al. |

FOREIGN PATENT DOCUMENTS

| | | | |
|---|---|---|---|
| FR | 1456468 | | 10/1966 |
| GB | 2303624 | | 2/1997 |
| WO | 2004018300 | A2 | 3/2004 |

OTHER PUBLICATIONS

Serpentine Modular Gravity Feed Can Dispenser, www.displayanddesign.com.au, Jul. 27, 2001.
POP & Sign regarding Welch's Juice Makers, Mar./Apr. 1997, p. 61.
Photograph of Welch's Juice Dispenser, www.mmcdisplay.com/gallery.html. Oct. 9, 1999.

* cited by examiner

MULTI-CHUTE GRAVITY FEED DISPENSER DISPLAY

CROSS-REFERENCE TO RELATED APPLICATIONS

This application is a continuation of U.S. application Ser. No. 14/861,017 filed Sep. 22, 2015, entitled "MULTI-CHUTE GRAVITY FEED DISPENSER DISPLAY" and issued Dec. 11, 2018 as U.S. Pat. No. 10,149,554, which is a continuation of U.S. application Ser. No. 14/459,600 filed Aug. 14, 2014, entitled "MULTI-CHUTE GRAVITY FEED DISPENSER DISPLAY" and issued Sep. 29, 2015 as U.S. Pat. No. 9,144,326, which is a continuation of U.S. application Ser. No. 11/164,784 filed Dec. 6, 2005, entitled "MULTI-CHUTE GRAVITY FEED DISPENSER DISPLAY" and issued Sep. 9, 2014, as U.S. Pat. No. 8,827,111, which is a continuation-in-part of U.S. application Ser. No. 10/600,387, filed Jun. 20, 2003, entitled "MULTI-CHUTE GRAVITY FEED DISPENSER DISPLAY", and issued Jan. 31, 2006, as U.S. Pat. No. 6,991,116, and which claims priority under 35 U.S.C. § 119(e) to U.S. Provisional Application No. 60/404,648, filed Aug. 20, 2002, all of which published applications and patents are expressly incorporated by reference herein.

BACKGROUND OF THE INVENTION

The present invention relates to dispenser racks and displays therefore, and more particularly, to a compact, easy to assemble, easy to load and unload multiple chute dispenser with an integrated display.

DESCRIPTION OF RELATED ART

Gravity feed dispensers have been used in the product dispensing markets, i.e., grocery stores, supermarkets, convenience marts and department stores, to provide on shelf storage, automatic rotation of stock, easy access for customers. The principal of operation is quite simple. The products are arranged on a rack which is inclined to horizontal such that when a customer removes one product at an end of a row of products, the entire row of products indexes forward one location equivalent to one product. Rollers are known to ease movement of the product.

One disadvantage of prior art gravity feed dispensers is that such devices are integrated into racks useful only for granting feed applications. Prior art gravity feed dispensers are not designed to be used in connection with standard shelving already in place at the retailer. As a result, the retailer must invest in additional specialized racks in order to provide a gravity feed apparatus.

Another disadvantage of prior art gravity feed dispensers is that they must be reloaded from the backside or topside thereof. As a result, gravity feed dispensers are usually not disposed in a back-to-back orientation. As a result, valuable floor space is wasted and the cost of operation is increased for the retailer.

Yet another disadvantage of prior art gravity feed dispensers is the customer's inability to return unwanted product. If a customer removes a product and then decides not to purchase, there is nowhere for the customer to replace the product in the gravity feed device. The row of product is too heavy for the customer to push back in order to reinsert the unwanted product. As a result, unwanted product is placed on shelves in other portions of the store. Costs associated with reshelving the unwanted product are incurred by the retailer.

Thus, there remains a need in the art for a compact, easy to assemble, easy to load and reload multi-chute gravity feed dispenser having an integrated display.

BRIEF SUMMARY OF THE INVENTION

A set of panels having chutes therebetween. The chutes being defined by curvilinear rails on such panels. The curvilinear rails having stops thereon for stopping the products for viewing.

DETAILED DESCRIPTION OF THE INVENTION

Figure 2:
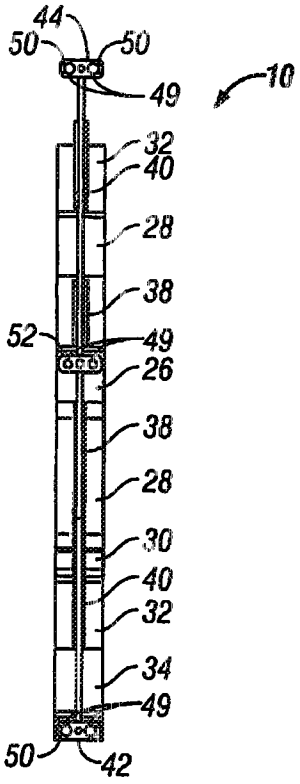
FIG. 2 is a an edge on view of a panel representing one embodiment of the invention.
Figure 1:
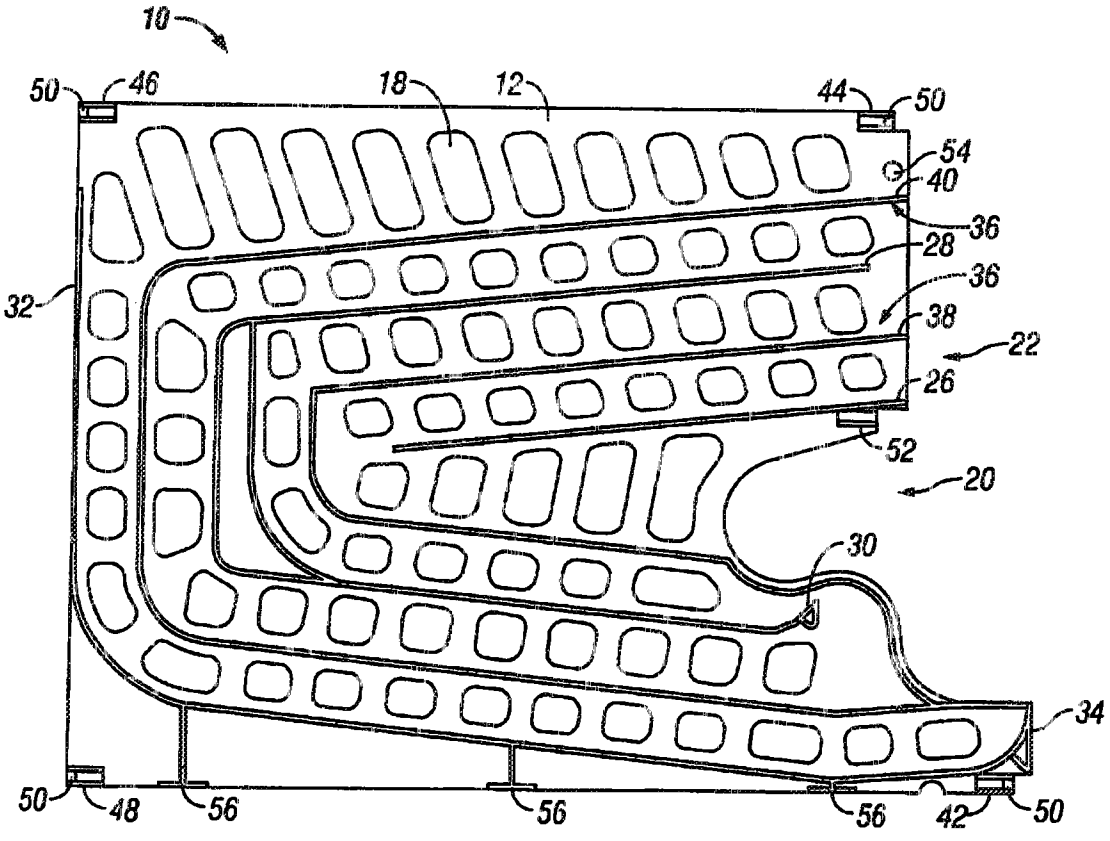
FIG. 1 is a side view of a panel representing one embodiment of the invention.

FIGS. 1 and 2 show a side and front view of the main element of the multi-chute gravity feed dispenser display, a panel 10 which is generally formed as a vertical upright panel. The panel 10 is preferably configured to be used in connection with conventional store shelving in place at a retailer having a depth in the range of 18 to 24 inches. In one embodiment of the invention the depth of the panel 10 is 20 inches overall and the height is 14 inches overall. It will be recognized by those of skill in the art that the embodiments discussed herein are configured to be adapted to conventional shelving. However, changes in scale or any dimension cited herein are within the scope of the present invention and may be adjusted based on any requirements for an application.

The panel 10 includes at least one set of rails 20 which are formed as ribs extending normal to a side 12 of the panel 10 to cooperatively define a plurality of chutes 22, 24 for product which have a boustrophedonic or C-shaped configuration. A first rail 26 is disposed in the generally medial portion of the side 12 inclined to the horizontal, angled generally downwardly, and having a linear configuration. The second rail 28 is disposed about the first rail 26 and has a curvilinear configuration which is substantially C-shaped. The first and second rails 26 and 28 each having a minimum incline to the horizontal such that product is capable of continuous movement along such rails in response to a normal gravitational force, and where as shown in FIG. 1, can be a substantially slight angle. A first product travel stop or stop 30 is formed at a lowest extent of the second rail 28 as an enlarged portion thereof. The first stop 30 engages the product to prevent unwanted further movement down chute 22 and positions the product for viewing and selection by a customer. A third rail 32 has a curvilinear configuration which is substantially L-shaped and has a second stop 34, formed as an enlarged portion thereof at a lower end adjacent first stop 30, and prevents further downward motion down chute 24. For structural rigidity and to provide visibility to the product positioned on first and second rails 26 and 28, cut out portions 18 or holes are formed along on panel 10 along the chutes described below. The cut out portions 18 also allow one to determine the quantity and contents of such chutes thus facilitating inventory control of the products stored therein.

At least one set of positioning elements 36 are formed on the side 12 as raised protrusions having a height normal to the side 12 less than the rails 26, 28 and 32. Each positioning element 38, 40 has a curvilinear configuration which is substantially C-shaped. The first positioning element 38 is disposed between the first and second rails 26, 28. The second positioning element 40 is disposed between the second and third rails 28, 32.

A plurality of bosses 42, 44, 46 and 48 are formed at each corner of the panel 10, and when used, provide greater rigidity to the multi-chute gravity feed dispenser display. Each has at least one aperture or bore 49 defined therein and a lock 50 associated with each bore 49. The lock mechanism or lock 50 is defined in the boss 42, 44, 46, 48 where a portion of an outer wall of the boss 42, 44, 46, 48 is removed to form a receptacle. The operation and function of the lock 50 will be described in more detail below. An additional boss 52 is formed in a generally medial position adjacent an end of the first rail 26. At least one bore 49 is defined therein. However, this boss does not include a lock.

An aperture 54 is formed in the panel 10 disposed between the second positioning element 40 and an upper boss 44 for positioning an access door as will be discussed in detail below. A plurality of feet 56 are formed on the side 12 and extend from the third rail 32 to the lower portion edge of the panel 10 in order to provide stability to the panel 10. Each foot 56 extends normal to the side 12 in the same manner as the rails 26, 28 and 32 to the same extent.

Figure 3A:
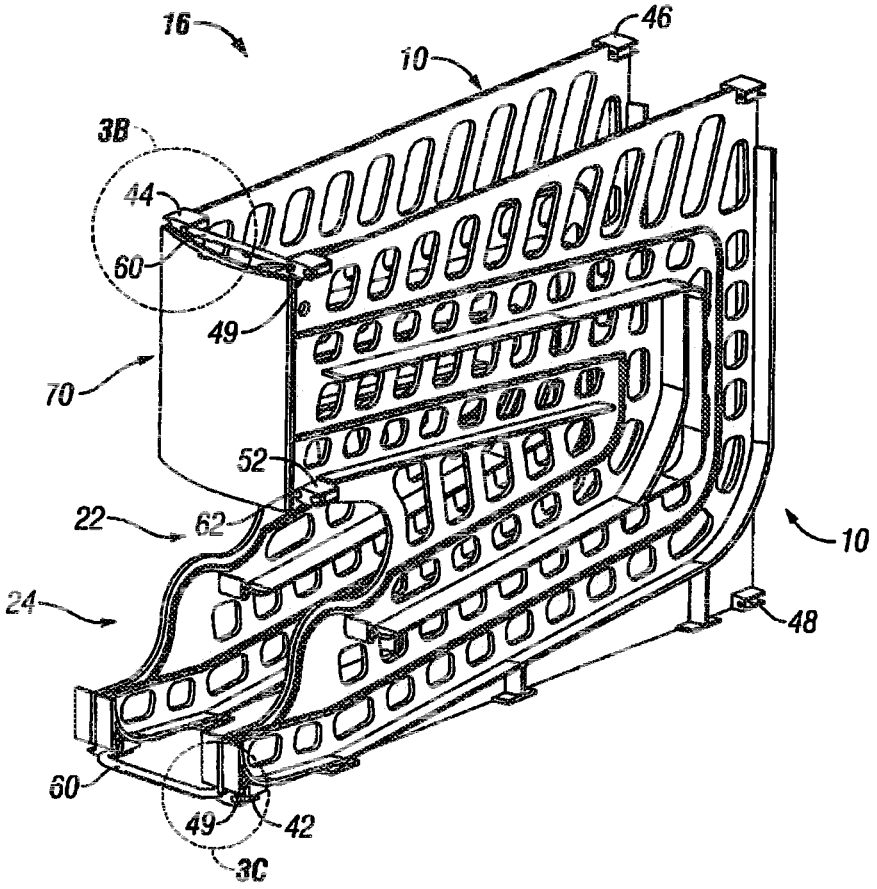
FIG. 3A is a side perspective view of a display module and representing one embodiment of the invention.

FIG. 3A shows a pair of panels, a display module 16, in accordance with the embodiment described in detail above, connected by a pair of retention pins to define a dispenser module 16, one or more such dispenser modules 16 making up a multi-chute gravity feed dispenser display. The chutes 22, 24 are defined between adjacent pairs of panels 10 and are of a width slightly greater than the width of products 90 and which allow the products to be stored and dispensed therefrom. The retention pins 60 engage the bores 49 defined in the bosses 42, 44 to maintain the panels 10 at a preselected spacing. Another retention pin (medially disposed 62) engages adjacent bosses 52 and is configured slightly different than the retention pin 60 as will be described in detail below. Additional retention pins 60 may be connected to the bores 49 in bosses 46, 48 for further rigidity and stabilization of the multi-chute gravity feed dispenser display. With all retention pins 60 in place between adjacent pairs of panels 10, such panels 10 are maintained substantially parallel to one another. Other embodiments may use more and/or less number of retention pins 60 and 62 as needed to provide sufficient support and structural integrity for the display module 16.

Figure 3B:
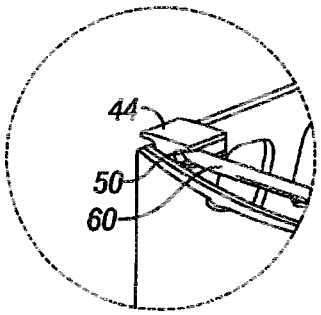
FIG. 3B shows the retention pin 60 disposed in a locked configuration representing one embodiment of the invention.
Figure 3C:
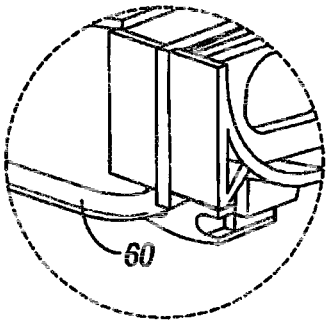
FIG. 3C shows the retention pin 60 disposed in an unlocked configuration representing one embodiment of the invention.

FIG. 3C shows a highlighted portion of FIG. 3A in detail. Retention pin 60 is shown disposed in an unlocked position partially removed from boss 44. It will be noted by those of ordinary skill in the art that retention pin 60 is disposed such that the panel 10 may rotate relative to the retention pin 60. Here, retention pin 60 is allowed to rotate within bore 49. This allows adjacent panels 10 to remain connected (engaged horizontally) when disposed offset to one another in a collapsed orientation as will be discussed in detail below.

FIG. 3B shows the retention pin 60 disposed in a locked configuration. This orientation is achieved by moving the retention pin 60 from the unlocked position shown in FIG. 3C into engagement with the lock 50 formed in each boss 44. It will be recognized by those of skill in the art that the same procedure applies for each retention pin 60 associated with a boss 42, 44, 46, 48 which has a lock 50. The lock 50 as described in detail above, essentially prevents rotation of the retention pin 60 relative to the panel 10. Here, retention pin 60 is not allowed to rotate within bore 49 due to lock 50. As a result, adjacent panels 10 are operatively connected (engaged both horizontally and vertically) such that they are relatively immovable, or fixedly positioned, with respect to one another so that unintended movement is restricted.

An access door 70 is connected to the medially disposed retention pin 62 and is movable relative thereto as described in detail below.

Figure 4C:
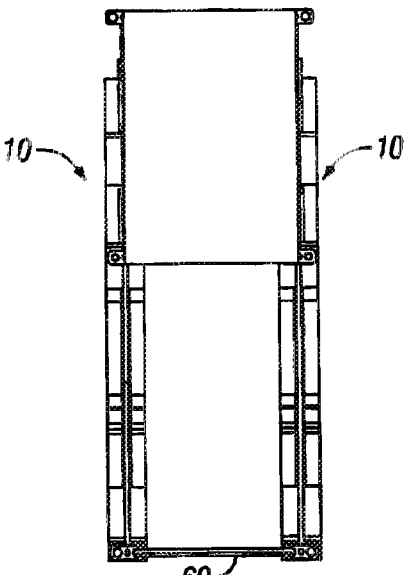
FIG. 4C is a front view of a display module and representing one embodiment of the invention.
Figure 4A:
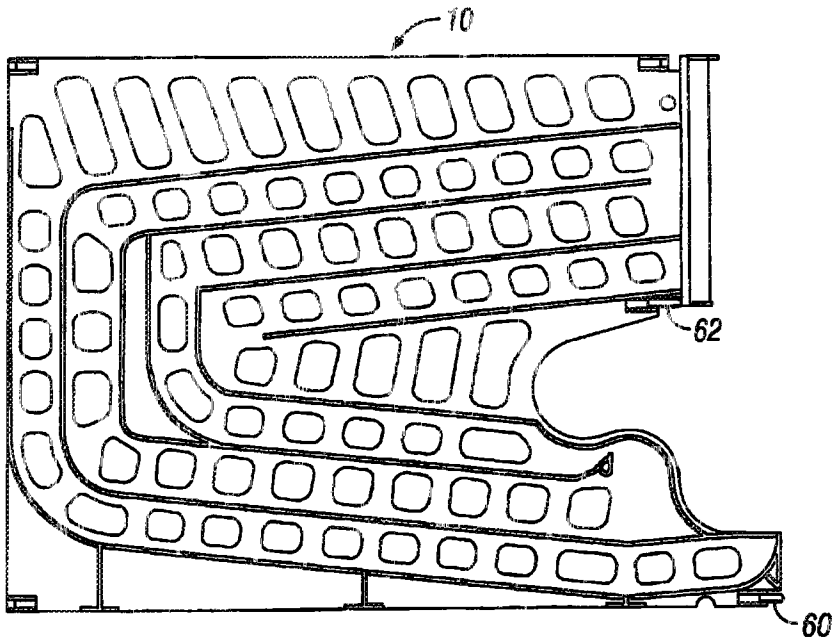
FIG. 4A is a side view of a display module and representing one embodiment of the invention.
Figure 4B:
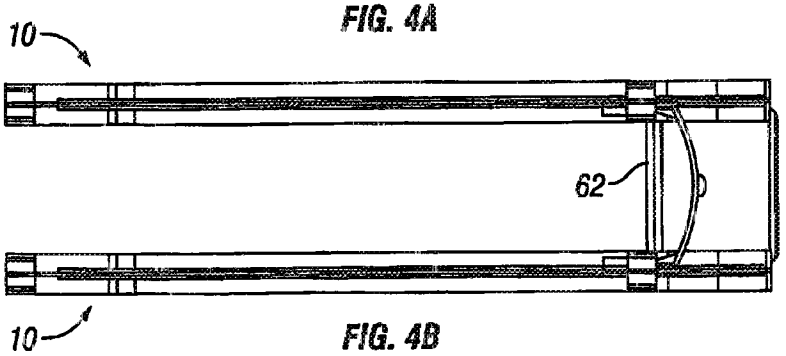
FIG. 4B is a top view of a display module and representing one embodiment of the invention.
Figure 5C:
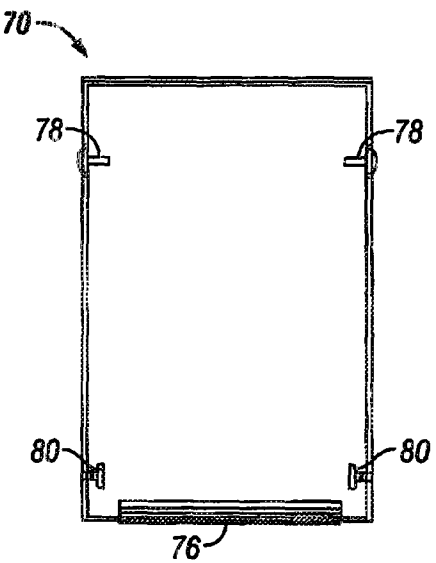
FIG. 5C is a rear view of the access door and representing an embodiment of the invention.
Figure 5B:
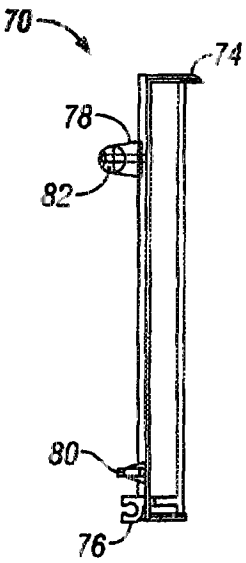
FIG. 5B is a side view of the access door and representing an embodiment of the invention.
Figure 5A:
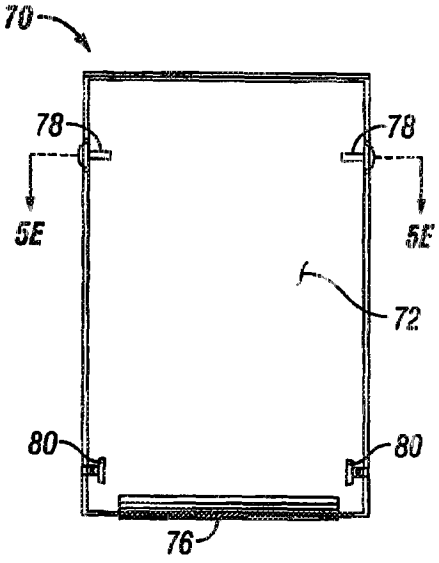
FIG. 5A is a front view of the access door and representing an embodiment of the invention.
Figure 5E:
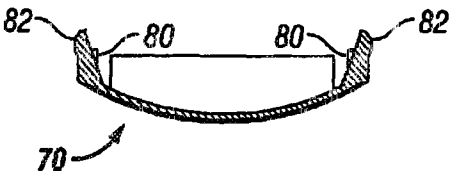
FIG. 5E is a cut-away top view of the access door and representing an embodiment of the invention.
Figure 5D:
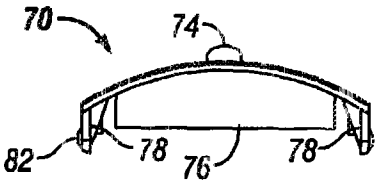
FIG. 5D is a top view of the access door and representing an embodiment of the invention.

FIGS. 4A, 4B and 4C show the side, top and front views of the multi-chute gravity feed dispenser display as described in FIGS. 3A, 3B and 3C. The panels 10 are preferably made from high impact styrene plastic. However, it will be recognized by those of skill in the art that any other suitable material of construction may be used that also provides a sufficiently low enough coefficient of friction to facilitate the movement of products within the multi-chute gravity feed dispenser display. Further, the panels 10 are preferably injection molded. Again, it will be recognized by those of skill in the art that any other suitable manufacturing technique may be used. The retention pins 60 and 62 are preferably made from stainless steel. However, it will be recognized by those of skill in the art that other materials of comparable strength and corrosion resistant properties may be used. One particular advantage of the present invention is the use of the replaceable retention pins. In the event that one of the retention pins breaks, it can be easily replaced. However, more likely, is that a panel 10 would break, and being replaceable/removable, the retention pins 60 and 62 could be removed from such panel 10, the panel can they be removed from among its adjacent panels, and a new panel 10 may be inserted in the same position and then have the retention pins 60 and 62 replaced and connected to the newly inserted panel 10. In either case, disassembly of the entire dispenser display is not required. Further, the dispenser display may be expanded to include as many additional panels as desired and shown in FIGS. 3A-C and 4A-C. In addition, although the embodiment shown in such figures utilize retention pins 60 and 62 having a particular length, other embodiments use retention pins having different lengths for the purpose of accommodating products that have a different height, (i.e., the height of a cylindrical article), than the height described herein regarding product 90. As such, different embodiments using different length retention pins 60 and 62, and that still use the panels 10 described herein, are able to accommodate products having different dimensions.

FIGS. 5A-D show various different views of the access door 70. The access door 70 includes a front face 72, a rear face 73, a handle 74, a clip 76, a pair of resilient arms 78 and a pair of alignment arms 80. The front face 72 is configured as slightly curved to present a pleasing appearance and increased surface area for advertising display purposes, such as alphanumeric and graphic indicia advertising the products therein. The handle 74 is disposed at the top of the access door 70 opposite the clip 76 and enables a user to easily move the access door from a closed position (access closing relation) to an open position (access opening relation) through an arc of at least 90 degrees. Preferably, the access door 70 is moved from a generally vertical orientation in the closed position to a orientation in the open position which is at least horizontal and preferably several degrees past horizontal. Other embodiments allow for the complete or partial removal of access door 70. The resilient arms 78 include an enlarged nub 82 which engages the aperture formed in the side 12 as discussed above with regard to FIGS. 1 and 2. The nub 82 provides a secondary connection for the access door to the panel 10. The clip 76 is the primary connection to adjacent panels 10. The clip 76 engages medially disposed retention pin 62 and moves relative thereto. Alignment arms 80 engage adjacent panels 10 when necessary in order to maintain the access door properly disposed between adjacent panels 10.

Figure 6A:
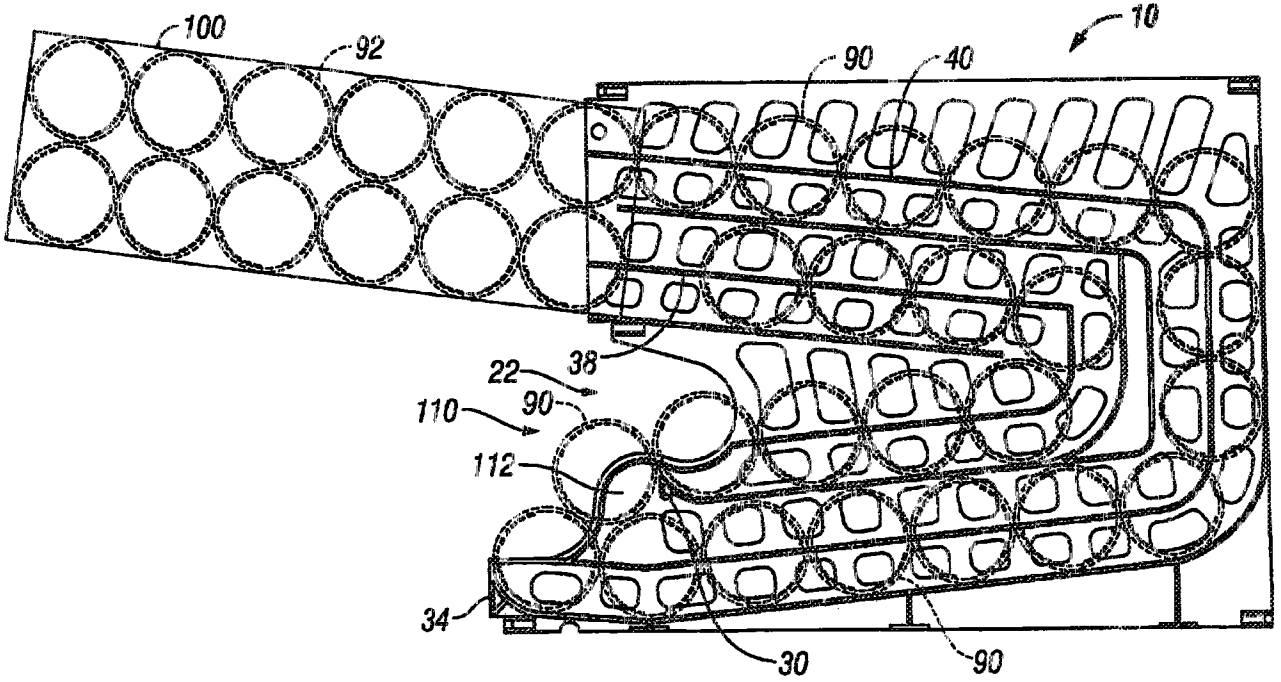
FIG. 6A is a side view of both a display module with a loading magazine in a loading position and representing an embodiment of the invention.

FIG. 6A shows the dispenser module 16 described in FIGS. 3A-3 and 4A-C with one panel 10 removed. The product 90 is loaded into the chutes 22, 24. The product 90 is shown as being of cylindrical form, and in this embodiment, represents cans of consumer goods. Other embodiments use a product 90 in a cylindrical form, but in the form of a jar, including glass, plastic or other typical jar materials. Yet additional embodiments use products 90 of a variety of other shapes or packaging designs, otherwise capable of being received by chutes 22 and 24. Further, the product 90 loaded into the different chutes 22 and 24 may be of a different design, whether external or internal. An external design difference could be size, shape, or material (i.e., glass jars or cans). An internal design difference may be different contents, such as different types of soup or different types of food. Chute 22 is a circuitous, serpentine path which is shorter than chute 24. As a result, more product 90 may be disposed in chute 24 than chute 22. However, other embodiments provide chutes 22 and 24 which such curvilinear structures that both chutes have the same length and are capable of containing the same amount of product 90.

When the supply of product 90 has been sufficiently depleted from chutes 22 and 24, new product 92 must be added. One advantage of the present invention is that additional new product 92 may be added to the multi-chute gravity feed dispenser display from the front. This is accomplished by moving the access door 70 from the closed position to the open position. It will be noted by those of skill in the art that the access door 70 has been removed from FIG. 6A for clarity purposes. Once the access door 70 has been opened a sleeve or loading magazine 100 is used to refresh the supply of product 90 in the multi-chute gravity feed dispenser display through its loading end, where the loading end includes the upper extents or portions of chutes 22 and 24, and where such upper extents of such chutes 22 and 24 represent a separate lower and upper loading port, respectively.

Further, the new products 92 are arranged in the loading magazine 100 such that two parallel rows (dual rows) are formed where an upper row traverses, or lies across, a lower row. Further, as shown, the new products 92 are arranged in pairs of upper and lower new products 92 within such dual rows with an upper new product lying across or on top of a lower new product. However, other embodiments use loading magazines 100 that have more or less rows of new product 92. Typically, although not required, the number of rows of new product 92 in loading magazine 100 is equal to the corresponding number of chutes in a dispenser module 16. Further, most embodiments of loading magazine 100 contain at least two new product 92 units in each of the rows contained therein. As such, and as shown in FIG. 6A, a loading magazine would typically consist of at least four new products 92, (two rows by two deep), but, as shown, actually consists of twelve, (two rows by six deep). Further, other embodiments contain multiple rows of new products 92 where the quantities per row for different rows are not equal. In addition, some embodiments contain rows of new products 92 that have different external and/or internal qualities, for example, some contain different size products in different rows, or different types of internal contents in different rows.

When loaded, the new product 92 simply rolls into the chute 22 or 24 whichever is empty and available. It will be recognized by those of skill in the art that the positioning elements 38 and 40 engage the end faces of the product 90 at point locations to center the product 90 between adjacent panels 10 and to reduce the rolling resistance of the product 90, 92 relative to the panels 10. Another advantage of the present invention is the return area or replace stall 110 which is defined between the first and second stops 30 and 34 and a cradle member or ear 112 formed on the panel 10. The replace stall 110 is further defined as an area in which a product 90 may be replaced if the consumer decides not to purchase.

As shown in FIG. 6A, a consumer has already replaced a product 90 which was not purchased. The next purchaser interested in the product 90 will then intuitively remove the product 90 from the replace stall 110 first as it is most easily removed. If another product 90 is desired, the consumer will pick the product from the lower extent, or dispensing end, of chute 22 or 24, and the next product in the appropriate chute 22 or 24 will index forward accordingly. The distal or dispensing ends of chutes 22 and 24 are also known as dispensing bays, or together, as a removal area. Similar to the situation where first stop 30 is located towards the rear of panel 10 in comparison to second stop 34, the dispensing bay associated with the first chute 22 is similarly located with respect to the dispensing bay associated with the second chute 24. Further, in this embodiment, the distance between such dispensing bays is slightly greater than the diameter of a products 90 unit. If the second product is then returned to the dispenser display, the replace stall is available for the consumer rather than the tedious and difficult chore of attempting to retention the product 90 backwards in the dispenser display while replacing the unwanted product 90. This represents a significant advantage over the prior art.

Further, although not shown in the FIGS., one embodiment provides an indicator that notifies an observer when the contents of the dispenser display reaches a certain minimum level of products 90. Here, the second chute 24 is designed such that when such certain minimum level of products 90, for example five, is reached in such chute, that the remaining minimum, or less, products 90, recede from contact with the second stop 34. This provides the advantage of notifying an observer of a low level of stock of product 90 before the product reaches a critical level, or runs out completely. The second chute 24 may be designed such that any desired minimum number of product 90 can be originally chosen as the amount which will provide the indication to an observer. Further, other embodiments provide the same indicator associated with the first chute 22, or any corresponding additional chute.

Figure 6B:
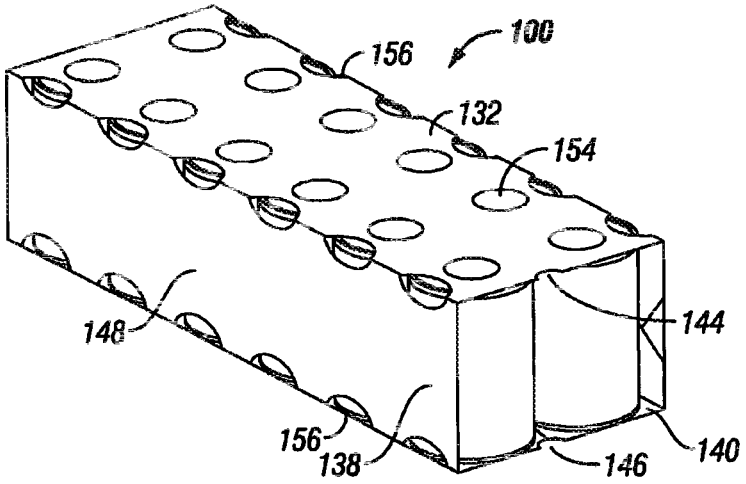
FIG. 6B is a side perspective view of a loading magazine showing the bottom side, porous side and the product ejection end, and representing an embodiment of the invention.
Figure 6C:
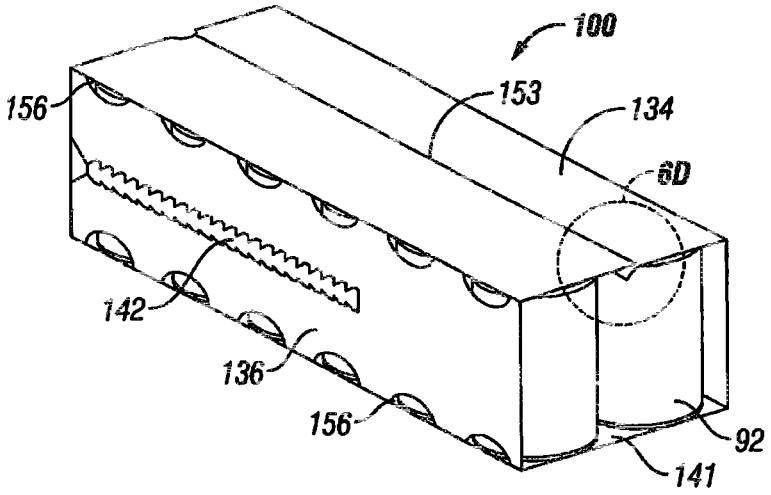
FIG. 6C is a side perspective view of a loading magazine showing the top side, non-porous side and the product non-ejection end, and representing an embodiment of the invention.
Figure 6D:
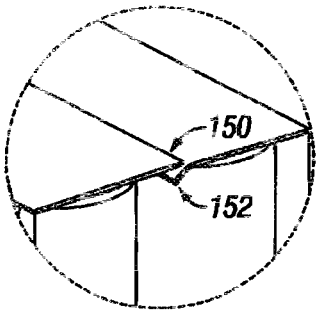
FIG. 6D shows the separated elongated ends of the paper overwrap of the loading magazine and representing an embodiment of the invention.

FIGS. 6B-6D show a more detailed depiction of loading magazine 100. First, it should be noted that as shown here, both products 90 and 92 are shown as cylindrical articles. Other embodiments use products of other shapes and sizes, and have outside enclosures with differing coefficients of friction, where such products have sufficient rolling, sliding or other movement along chutes 22 and 24 so that multi-chute gravity feed dispenser display operates as described herein where gravity is used to dispense the products to product consumers. Such other embodiments include, for example, products having a substantially cylindrical form, and those having multiple outer sides that still allow the product to rotate as it travels along chutes 22 and 24. The loading magazine 100 includes a porous side 132, a non-porous side 134, a top side 136 and a bottom side 138, a product ejection end 140 and a product non-ejection end 141. In addition, FIG. 6C shows a tear strip 142 on top side 136. Both the porous side 132 and the non-porous side 134 have loading notches 144 and 146, respectively, at the product ejection end 140 of the loading magazine 100. Further, the entire casing which makes up the loading magazine 100 is a paper overwrap 148 with elongated ends 150 and 152, where such elongated ends are attached forming a overlap seam 153.

As shown in FIG. 6B, a porous side 132 contains holes 154 which provides access to the top of the new products 92 where markings, including alphanumeric indicia, can be either applied or observed without removing such products from the loading magazine 100. The porous side 132 in other embodiments are absent such holes 154. Further, each of the porous side 132, non-porous side 134, top side 136 and bottom side 138, each have slit protrusions 156 or apertures that provides room for the new products 92 to be received, and each slit protrusion 156 area stretches or bulges outwardly along the top and bottom sides 136 and 138 such that such new products 92 are statically secured via an enclosing force from moving along such sides 136 and 138, and as a result, loading magazine 100 need not include end members to statically secure the new products 92 from exiting from either of its ends. Other embodiments do not include slit protrusions 156 about the loading magazine 100. Further, other embodiments also include structures, such as full or partial walls to achieve the necessary enclosing force, such as walls that cover all or part of both or either the product ejection end 140 and the non-product ejection end 141. In some embodiments, partial walls are created by folds in the overwrap 148, which prevent new products 92 from exiting the magazine 100 from both its product ejection end 140 and its non-product ejection end 141.

As shown in FIG. 6C, a tear strip 142 is located on the top side 136 of the loading magazine 100. Here, the tear strip 142 is a perforated strip. Other embodiments use other forms of tear strips including adhesive strips and pull string tear strips, while others use no tear strip at all. Some embodiments place the tear strip 142 along an overlap seam 153 located on the top side 136, while others locate such tear strips 142 on other sides of the loading magazine 100, while yet others locate the tear strips 142 circumferentially about the periphery of the loading magazine 100. As shown in FIG. 6B, loading notches 144 and 146 are provided here to allow the further insertion of the loading magazine into the multi-chute gravity feed dispenser display by allowing the upper extents of two corresponding first rails 26 to slide into such loading notches 144 and 146. At least one embodiment, which utilizes a loading magazine 100 having a single row of new product 92 therein, may be advanced down a portion of the length of either chute 22 or 24 such that the portion at most reaches or approaches the first curve in such chutes.

Although the paper overwrap 148 here is made out of paperboard, such as Kraft paperboard, generally made from cross-directional fibers providing some level of expansion and retraction within the paperboard itself, and having a caliper range between 0.012 and 0.26 and a weight per 1,000 square feet of between 32 and 90 pounds, (for example, a 32, 42 and 68 pound Kraft liner), other embodiments have paper overwrap 148 made out of bleached sulfate, while others are made from thermoplastic film. The structure that results from the covering of the new product 92 with an overwrap 148 in addition to being called a loading magazine 100 is also referred to as a tube. Here, the elongated ends 150 and 152 of the paper overwrap 148 are attached to one another via a glue agent forming overlap seam 153. Other embodiments form overlap seam 153 by using an attachment agent other than glue. Further, other embodiments, such as those having a paper overwrap 148, are absent any overlap seam 153 or elongated ends 150 or 152. Yet other embodiments, such as those having a tear strip 142, attach elongated ends 150 and 152 together via such tear strip 142. Although not shown in FIGS. 6B-6D, some embodiments utilize an intermediate wall within loading magazine 100. Such wall is located between the rows of new product 92, i.e., the row of new product 92 adjacent the top side 136 and the row of new product 92 adjacent the bottom side 138.

The loading magazine 100 is designed to secure a set of new product 92 such that the set can me easily transported to the location of the multi-chute gravity feed dispenser display. The loading magazine 100 is further designed to provide a convenient way to load or feed new product 92 into the multi-chute gravity feed dispenser display where new product 92 is ejected or expelled from the magazine 100 onto one or both of the highest extents of the first and second rail 26 and 28. As shown in FIG. 6A, loading magazine 100 is positioned for loading such that its bottom and top sides 138 and 136 are angled such that gravity provides an urging force against the new product 92 therein towards the product ejection end 140. Before the new product 92 can flow however, the securing force or pressure about loading magazine 100 must be released, for example, where a perforated tear strip 142 is pulled from the top side 136 fracturing such perforations, or where the product ejection end 140 is obscured by a wall, and the wall is removed. In either case the ejection end 140 is expanded or otherwise opened. Upon release, the new product 92 flows down loading magazine 100 and onto first and/or second rails 26 and 28. For those embodiments including a middle wall between the upper and lower rows of new product 92, each such row is directed only to its corresponding second and first rails 28 and 26 respectfully.

As long as the multi-chute gravity dispenser display is not completely full, multiple loading magazines may be emptied there in. Where the multi-chute gravity dispenser reaches its full condition before a current loading magazine is emptied, such loading magazine 100 is then pivotally adjusted about its product ejection end 140, where the product non-ejection end 141 moves lower portion of a panel 10, resulting in the remaining new product resting in the product non-ejection end 141 portion of the loading magazine 100.

Figure 7:
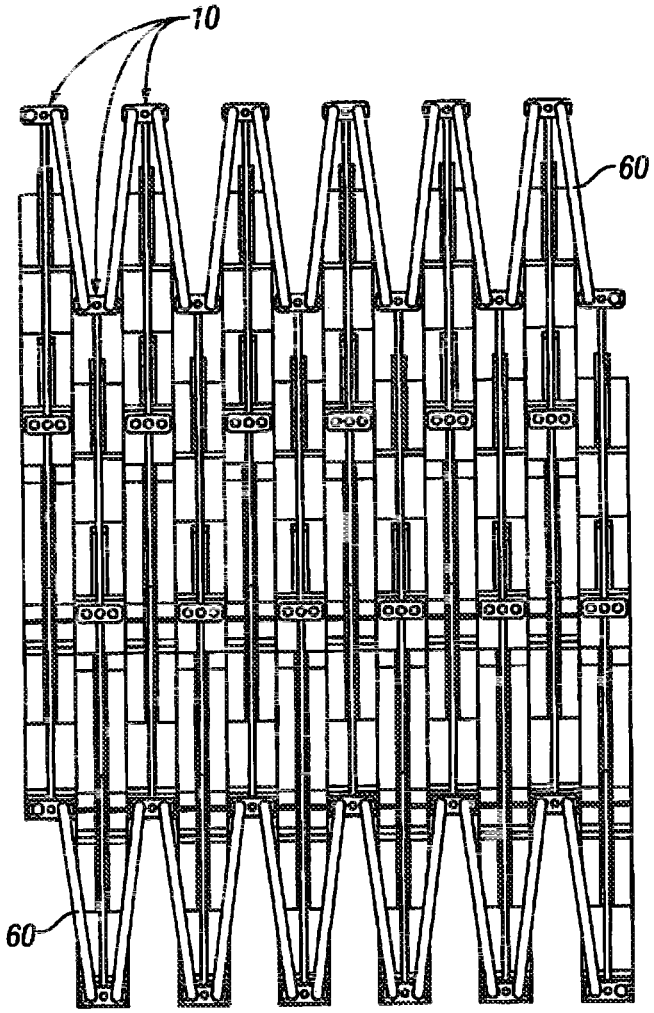
FIG. 7 is a relational front view of multiple attached panels in a collapsed position and representing an embodiment of the invention.

FIG. 7 shows one embodiment of the multi-chute gravity feed dispenser display in a collapsed position. The dispenser display shown herein includes a plurality of panels 10 which are offset from one another connected by retention pins 60 disposed in the unlocked position. As shown, the panels 10 have been advanced toward each other in an accordion-type manner until reaching abutment or contact against one another in a compressed position with retention pins 60 extended at an angle away from the horizontal. As a result, the overall width of the dispenser display is only 12.3 inches. It will be recognized by those of skill in the art that the overall width of any dispenser display is dependent upon the number of panels selected for use. In other words, the more panels used, the wider the overall width and vice versa.

Figure 8:
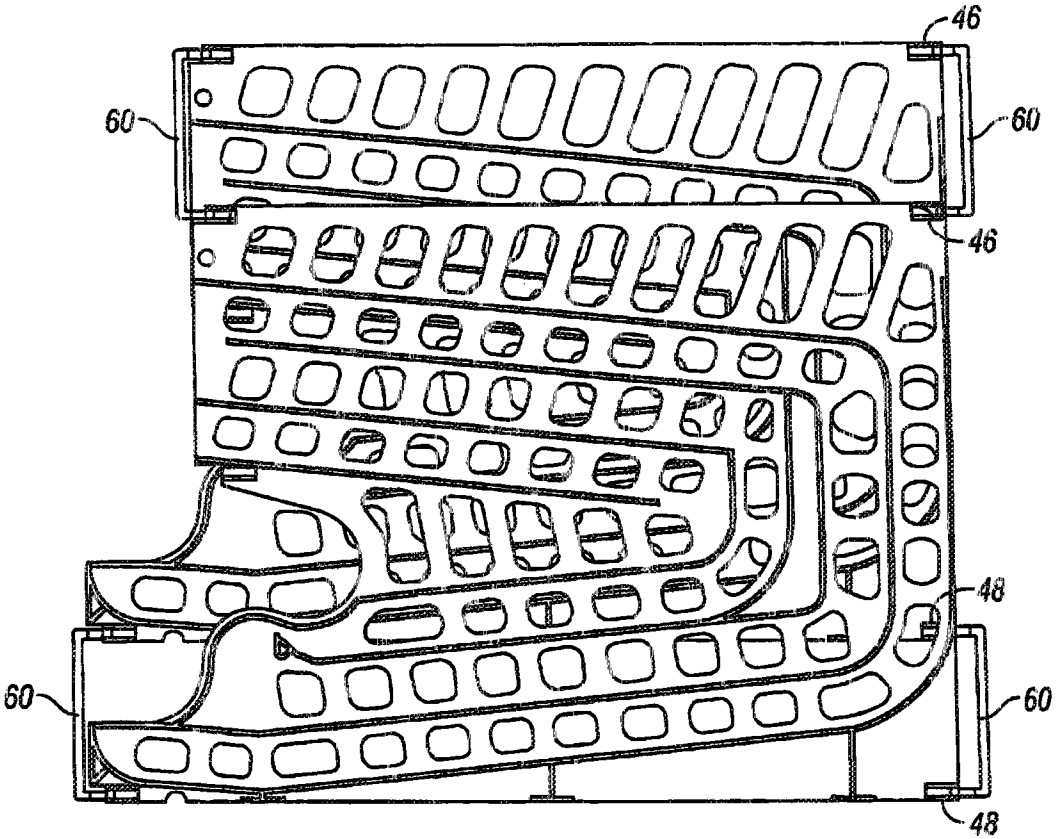
FIG. 8 is a relational side view of two attached panels in a collapsed position and representing an embodiment of the invention.

FIG. 8 shows a side view of the collapsed dispenser display of FIG. 7. The retention pins 60 are clearly shown in the unlocked position and also disposed in the rearward bosses 46, 48. The overall depth of the dispenser display in the collapsed position with the retention pins 60 disposed in the unlocked position is 21 inches. The overall height of the dispenser display in this configuration is 17.8 inches.

Figure 9:
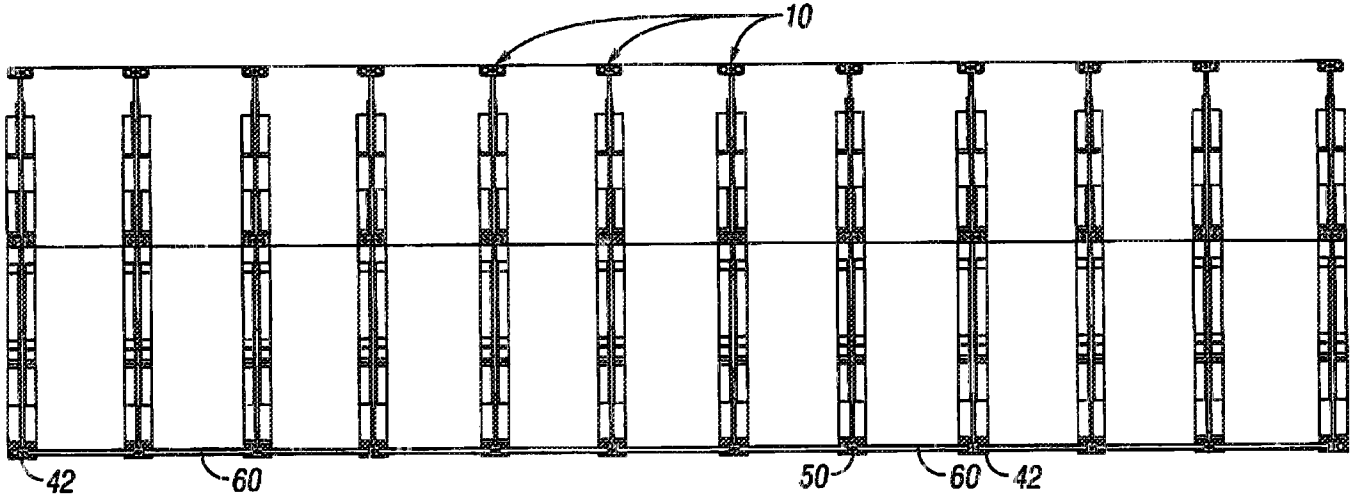
FIG. 9 is a front view of multiple attached panels in an expanded position and representing an embodiment of the invention.

FIG. 9 shows a front view of the dispenser display of FIGS. 7 and 8 in an expanded configuration. The overall width of the dispenser display is 47.871 inches. It will be recognized by those of skill in the art that there is a significant difference between the dimensions of the dispenser display from the collapsed to the expanded configurations. As a result, there is a significant savings in shipping and storage costs as the dispenser display in the collapsed position is much smaller. After the dispenser display is moved from the collapsed to the expanded position, the retention pins 60 may be moved to engage the locks 50 formed in bosses 42, 44, 46 and 48. The resulting structure is then rigid and stable for use. Further, because the retention pins 60 are already in place when the dispenser display is received for installation, the steps needed to achieve a rigid structure are reduced to the steps of locking such retention pins 60, and as result, provides benefits at the assembly end of the process where assembly time and assembly errors are reduced. Although the embodiment shown in such figures utilize retention pins 60 and 62 having a particular length, other embodiments use retention pins having different lengths for the purpose of accommodating products that have a different height, (i.e., the height of a cylindrical article), than the height described herein regarding product 90. As such, different embodiments using different length retention pins 60 and 62, and that still use the panels 10 described herein, are able to accommodate products having different dimensions.

Figure 10A:
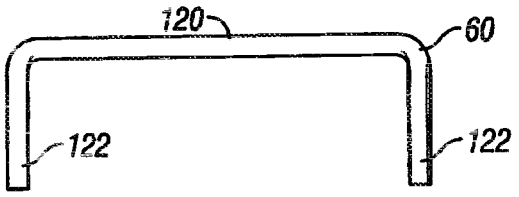
FIG. 10A is a top view of a retention pin and representing an embodiment of the invention.
Figure 10B:
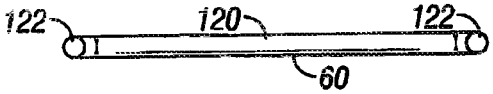
FIG. 10B is a rear view of a retention pin and representing an embodiment of the invention.
Figure 10C:
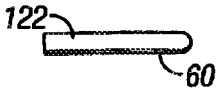
FIG. 10C is a side view of a retention pin and representing an embodiment of the invention.

FIGS. 10A, 10B and 10C show retention pin 60 in greater detail. The retention pin 60, having a U-shape, has a main portion 120 and a pair of arms 122 disposed in opposition which have been formed normal to the main portion 120. In this embodiment, the arms 122 have a length from their distal end to the center line of the main portion 120 of approximately 1.25 inches. The overall width on center from arm-to-arm is approximately 3.761 inches. The diameter of the retention pin is preferably approximately 0.188 inches.

Figure 11A:
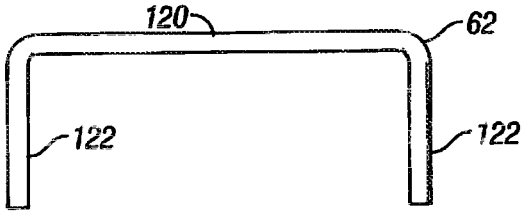
FIG. 11A is a top view of medially disposed retention pin and representing an embodiment of the invention.
Figure 11B:
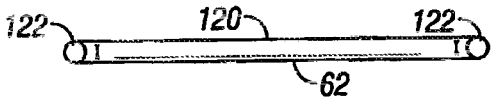
FIG. 11B is a rear view of medially disposed retention pin and representing an embodiment of the invention.
Figure 11C:
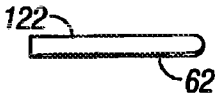
FIG. 11C is a side view of a medially disposed retention pin and representing an embodiment of the invention.

FIGS. 11A, 11B and 11C show the structural configuration of medially disposed retention pin 62. It will be recognized by those of skill in the art that medially disposed retention pin 62 is substantially similar to retention pin 60 described in FIGS. 10A-C. The difference between the two is that the arms 122 in medially disposed retention pin 62 have a length from their distal end to the center line of the main portion 120 of approximately 1.5 inches. Other dimensions remain the same. It will be recognized by those of skill in the art that any of the dimensions of the retention pins may be adjusted to suit different design parameters. The medially disposed retention pin 62 has an increased length over the retention pin 60 so that it may be used in the generally medial position in connection with boss 52 so that the access door is properly positioned when clip 76 engages the main portion 120 of medially disposed retention pin 62.

Figure 12:
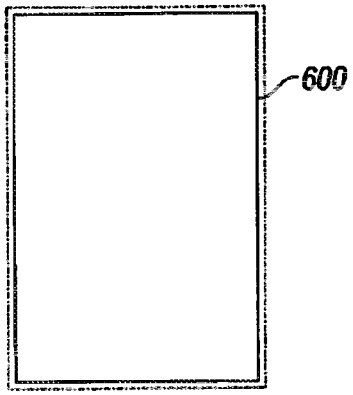
FIG. 12 is a template indicating the advertising area available on access door and representing an embodiment of the invention.

FIG. 12 shows a template 600 for the display area available on the access door 70. Another advantage of the present invention is that additional display space is not required. The access door provides sufficient area to advertise the products disposed within the multi-chute gravity feed dispenser display. The display area may be covered with a variety of signage including, an adhesive backed material. (preferably using a weak or light adhesive amount), a plastic or paper sheet having tabs to interlink with corresponding slots on the access door 70, or other suitable advertising medium.

Figure 13A:
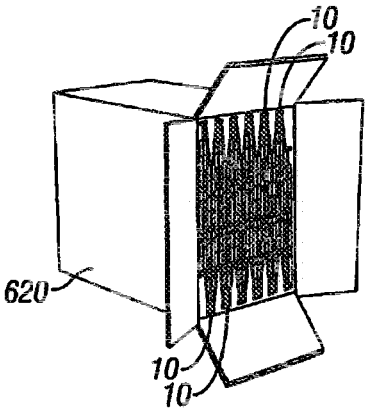
FIG. 13A shows an the multi-chute gravity feed dispenser display in a collapsed configuration disposed within a shipping box and representing an embodiment of the invention.

FIG. 13A shows an embodiment of the multi-chute gravity feed dispenser display in a collapsed configuration disposed within a shipping box 620.

Figure 13B:
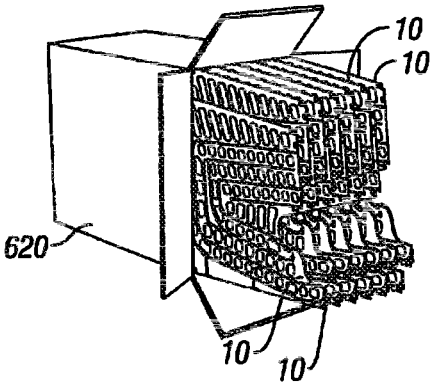
FIG. 13B shows the multi-chute gravity feed dispenser display in a collapsed configuration partially removed from the shipping box and representing an embodiment of the invention.

FIG. 13B shows an embodiment of the multi-chute gravity feed dispenser display in a collapsed partially removed from the shipping box 620.

Figure 13C:
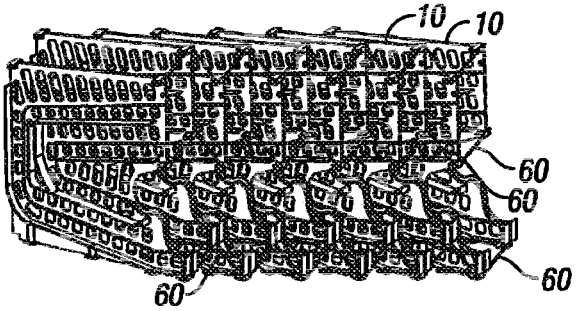
FIG. 13C shows the multi-chute gravity feed dispenser display in a partly expanded configuration and representing an embodiment of the invention.

FIG. 13C shows an embodiment of the multi-chute gravity feed dispenser display in a partly expanded configuration as compared to FIGS. 13A and 13B. The retention pins 60 are shown in the unlocked position.

Figure 13D:
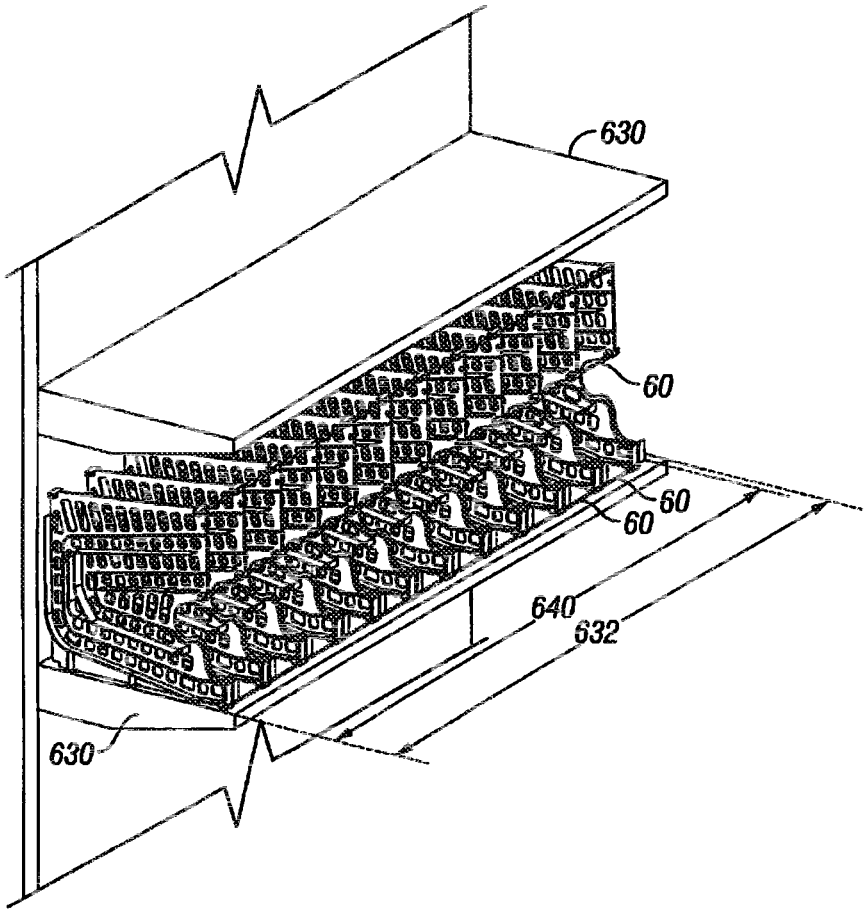
FIG. 13D shows the multi-chute gravity feed dispenser display disposed in an expanded configuration with the retention pins in a locked position.

FIG. 13D shows an embodiment of the multi-chute gravity feed dispenser display disposed on a conventional shelf 630 in an expanded configuration with the retention pins 60 in a locked position. A conventional shelf 630 having a 48 inch width 632 is also shown. The overall width 640 of the expanded multi-chute gravity feed dispenser display is 47.871 inches. Accordingly, the dispenser display is easily disposed upon the conventional shelf 630.

Figure 13E:
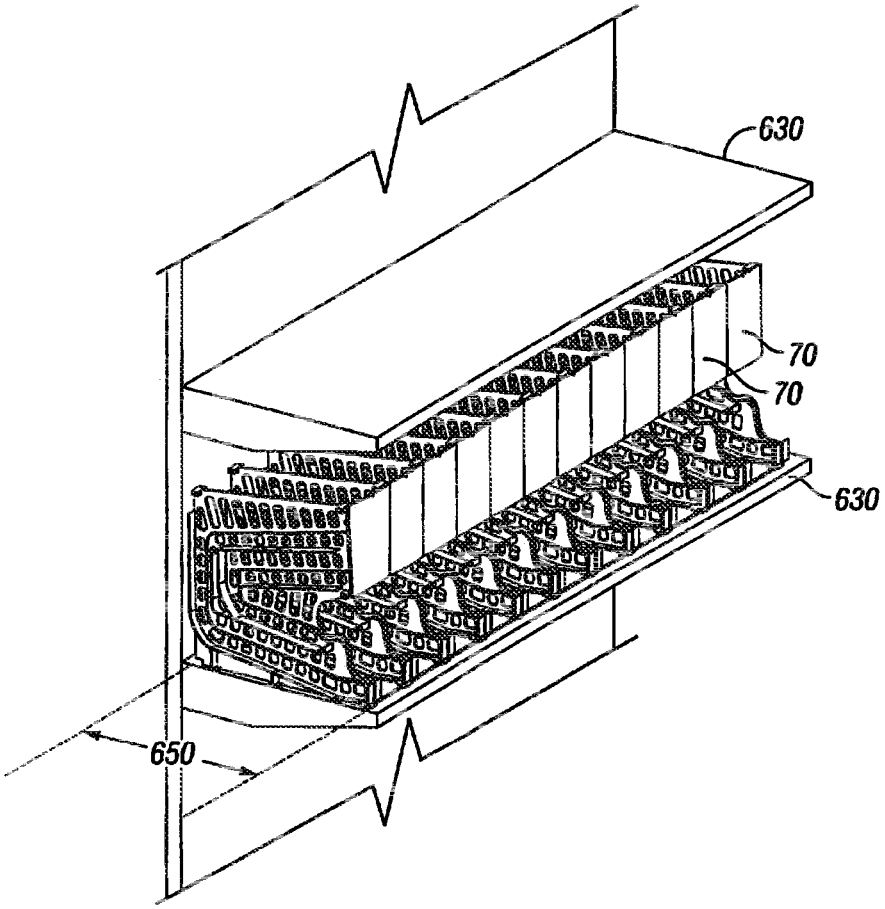
FIG. 13E shows an the multi-chute gravity feed dispenser display with the access doors in the closed position with product decals applied and representing an embodiment of the invention.

FIG. 13E shows an embodiment of the multi-chute gravity feed dispenser display of FIG. 13D with the magazine access doors 70 assembled and product decals applied, where the access door 70 is disposed in the closed position. It will also be noted that the depth 650 of the multi-chute gravity feed dispenser display is 20 inches which is easily accommodated on a conventional shelf 630.

Figure 14A:
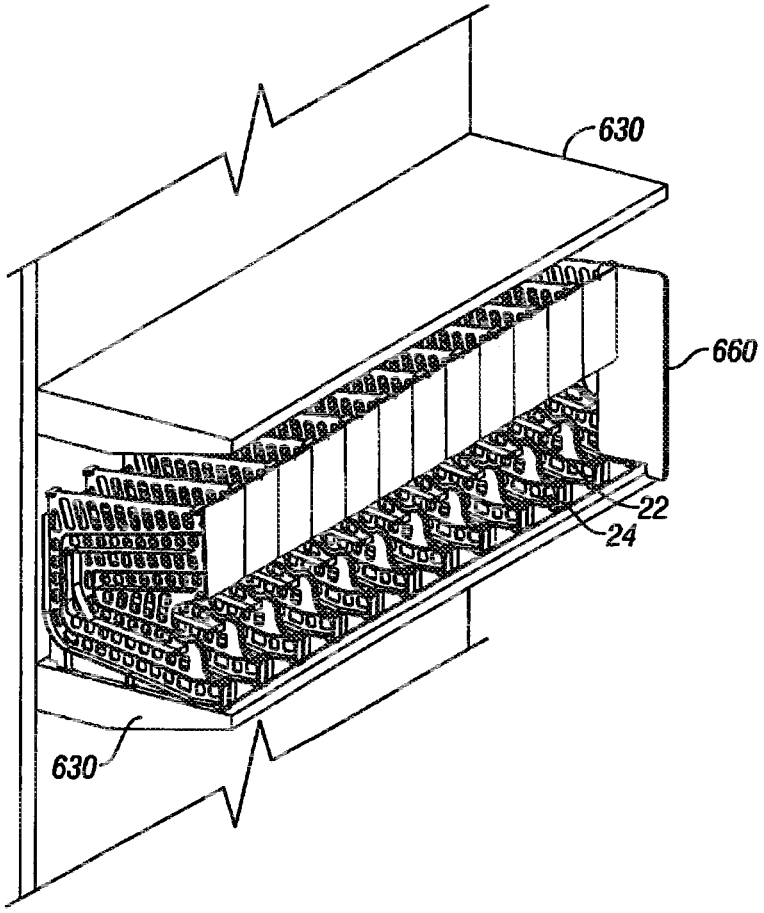
FIG. 14A shows the multi-chute gravity feed dispenser display with a category sign connected thereto and representing an embodiment of the invention.
Figure 14B:
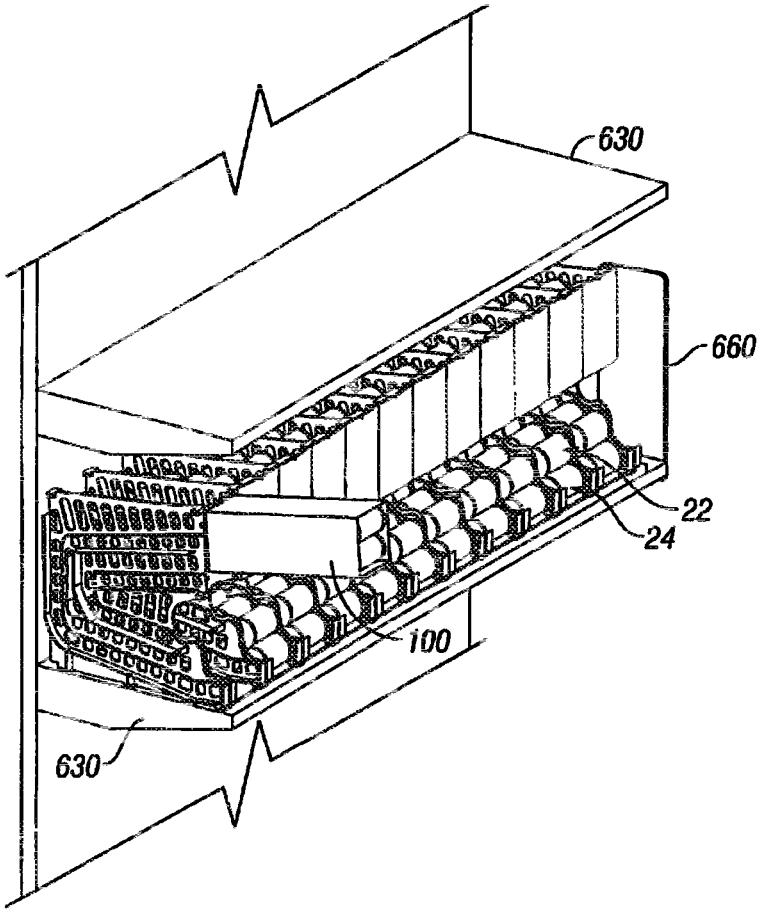
FIG. 14B shows product being loaded into the multi-chute gravity feed dispenser display and representing an embodiment of the invention.

FIG. 14A shows an embodiment of the multi-chute gravity feed dispenser display with an additional display item in the form of a category sign 660 connected thereto.

FIG. 148 shows product being loaded into an embodiment of the multi-chute gravity feed dispenser display of the present invention. The access door 70 is moved from a closed position to an open position such that the magazine 100 may be in communication with the chutes 22 and 24 so that the product may be loaded.

Figure 14C:
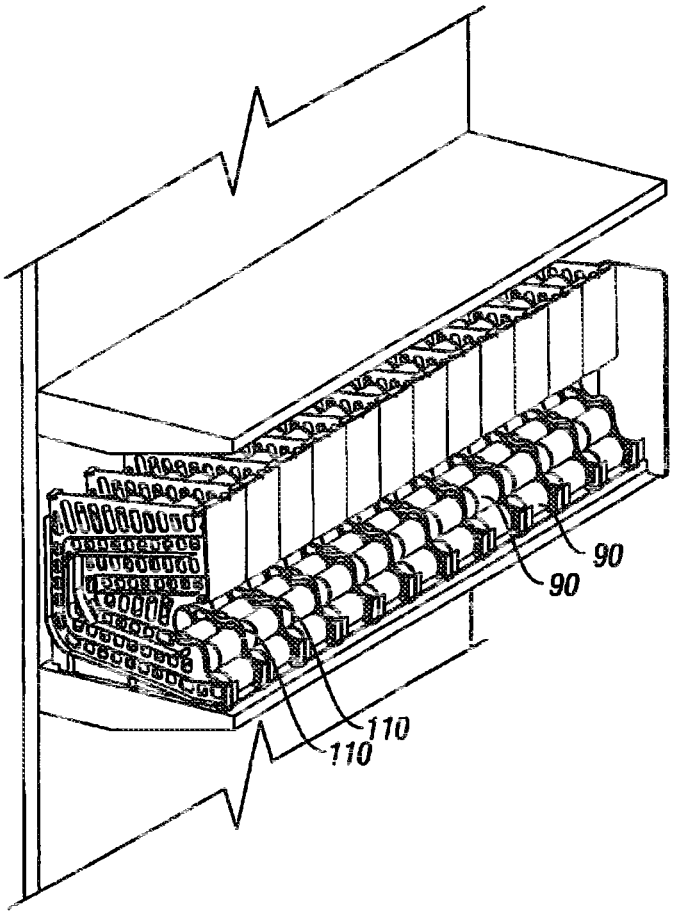
FIG. 14C shows an the multi-chute gravity feed dispenser display filled with product and ready for retail and representing an embodiment of the invention.

FIG. 14C shows an embodiment of the multi-chute gravity feed dispenser display filled with product 90 and ready for retail. The replaced stall 110 in each module has product disposed therein for maximum initial density.

Figure 15:
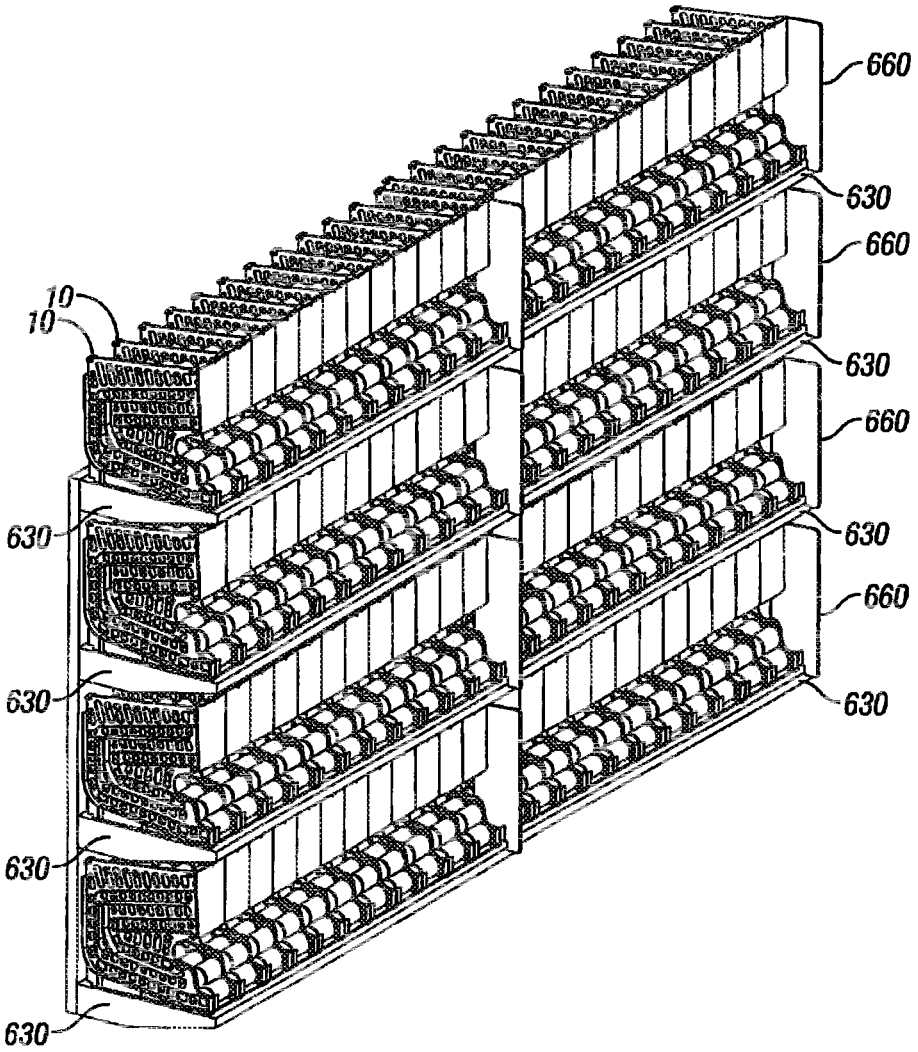
FIG. 15 shows a plurality of multi-chute gravity feed dispenser displays disposed on a number of adjacently disposed conventional shelves and representing an embodiment of the invention.

FIG. 15 shows a plurality of multi-chute gravity feed dispenser displays disposed on a number of adjacently disposed conventional shelves 630.

Figure 17:
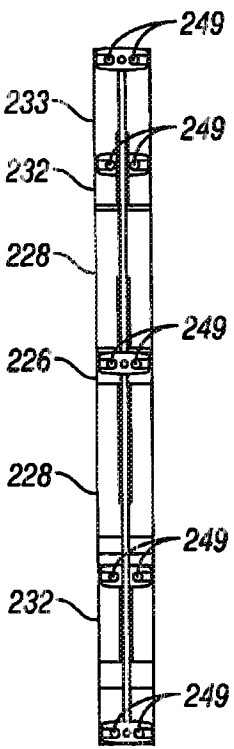
FIG. 17 is an edge on view of the panel of FIG. 16 representing one embodiment of the invention.
Figure 16:
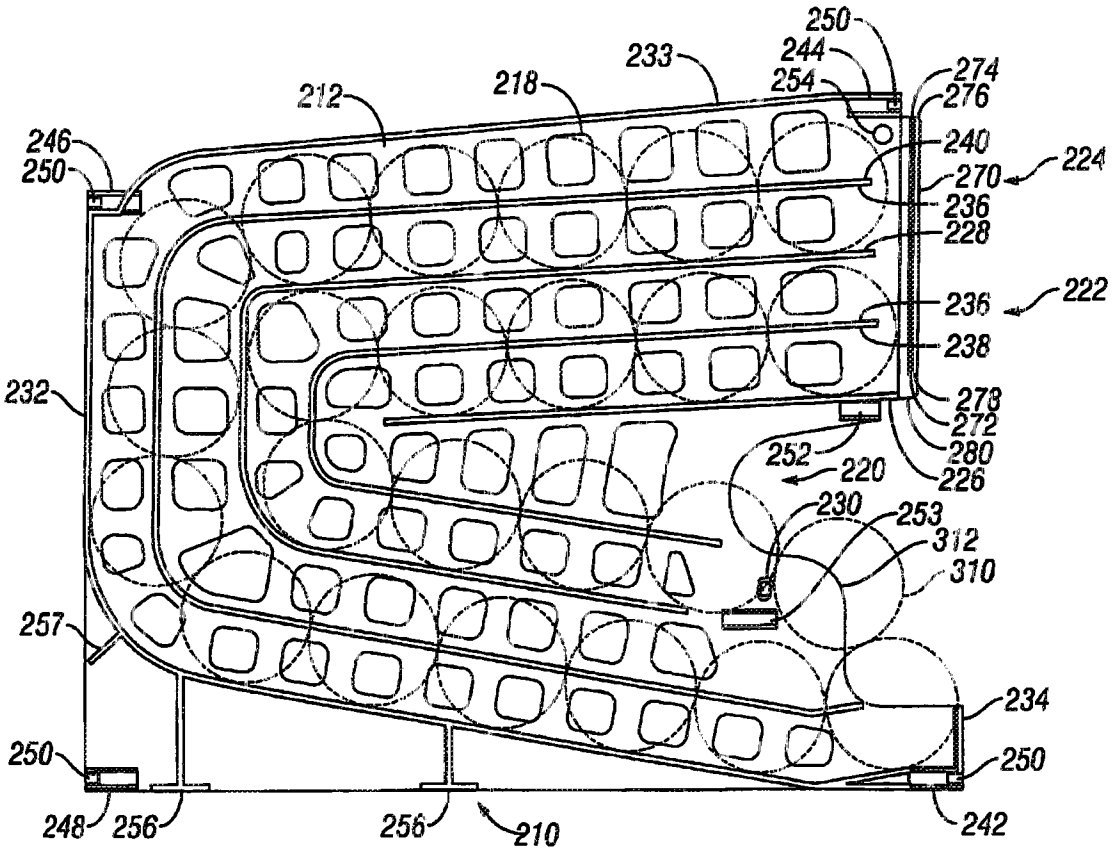
FIG. 16 is a side view of a panel representing one embodiment of the invention.
Figure 18:
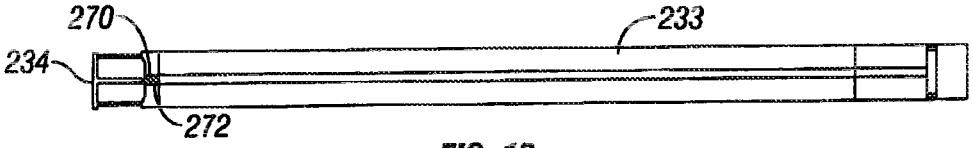
FIG. 18 is a top view of the panel of FIGS. 16 and 17 representing one embodiment of the invention.
Figure 19:
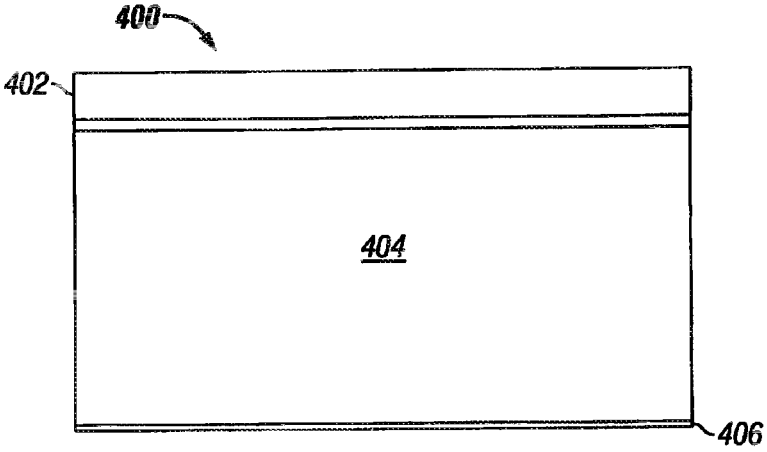
FIG. 19 is a side view of a display member representing one embodiment of the invention.
Figure 20:
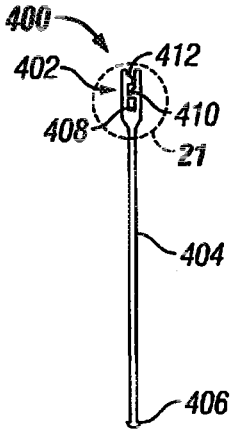
FIG. 20 is a side edge on view of a display member representing one embodiment of the invention.
Figure 21:
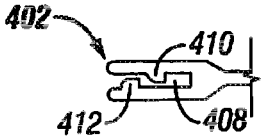
FIG. 21 is a close up view of a clamp section of a display member and representing one embodiment of the invention.
Figure 22:
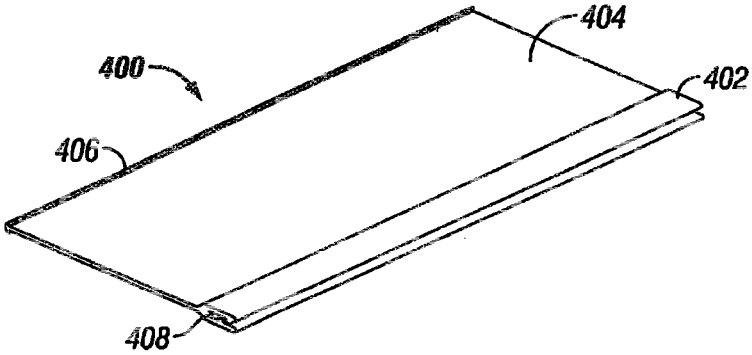
FIG. 22 is a side perspective view of a display member and representing one embodiment of the invention.
Figure 23:
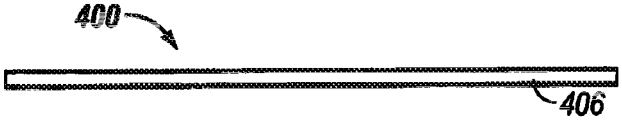
FIG. 23 is a front edge on view of a display member representing one embodiment of the invention.
Figure 24C:
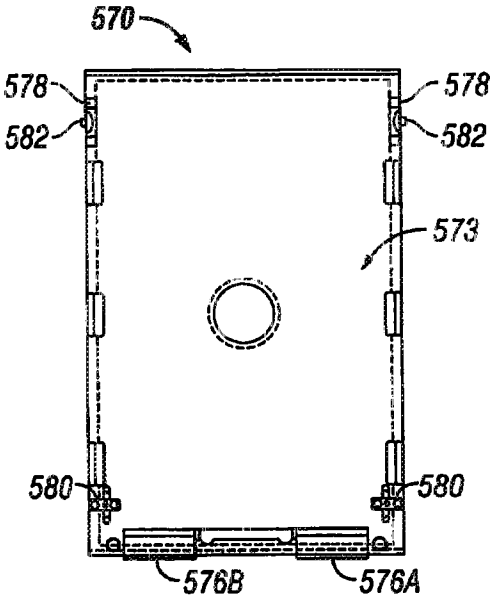
FIG. 24C is a rear view of the access door and representing an embodiment of the invention.
Figure 24B:
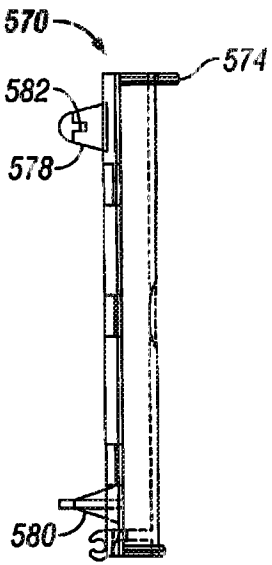
FIG. 24B is a side view of the access door and representing an embodiment of the invention.
Figure 24A:
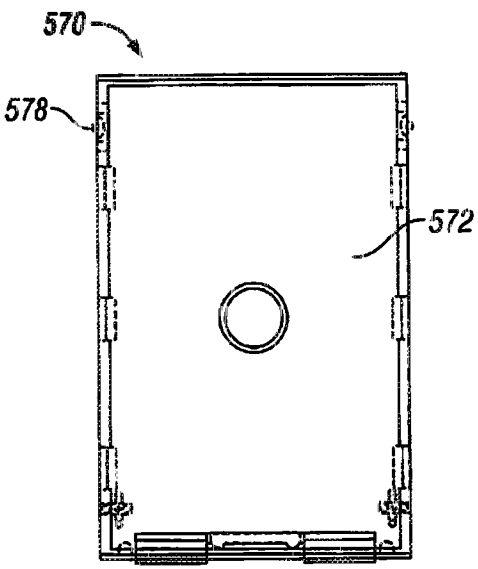
FIG. 24A is a front view of the access door and representing an embodiment of the invention.
Figure 24E:
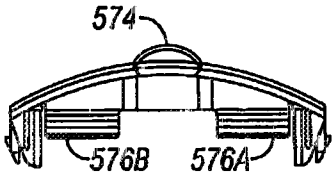
FIG. 24E is a bottom view of the access door and representing an embodiment of the invention.
Figure 24D:
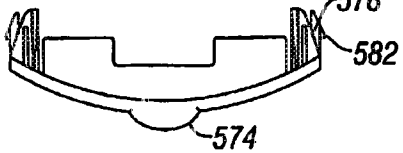
FIG. 24D is a top view of the access door and representing an embodiment of the invention.

FIGS. 16, 17 and 18 show a different embodiment of the main element of the multi-chute gravity feed dispenser display, (FIGS. 1 and 2 show another such embodiment), where a panel 210 represents a vertical upright panel designed to be remotely mated with other like panels 210. Further, the panel 210 is shown to be supporting a full load of product 92. The panel 210 includes at least one set of rails 220 which are formed as ribs extending normal to a side 212 of the panel 210 to cooperatively define a plurality of chutes 222, 224 for product which have a boustrophedonic or C-shaped configuration.

A first rail 226 is disposed in the generally medial portion of the side 212 inclined to the horizontal, angled generally downwardly, and having a linear configuration. The second rail 228 is disposed about the first rail 226 and has a curvilinear configuration which is substantially C-shaped. The first and second rails 226 and 228 each having a minimum incline to the horizontal such that product is capable of continuous movement along such rails in response to a normal gravitational force, and where as shown in FIG. 16, can be a substantially slight angle. A first product travel stop or stop 230 is formed at a lowest extent of the second rail 228 as an enlarged portion thereof. The first stop 230 engages the product to prevent unwanted further movement down chute 222 and positions the product for viewing and selection by a customer.

A third rail 232 has a curvilinear configuration which is substantially L-shaped and has a second stop 234, formed as an enlarged portion thereof at a lower end adjacent first stop 230, and prevents further downward motion down chute 224. In addition, a return area or replace stall 310, defined between the first and second stops 230 and 234 and a cradle member or ear 312 formed on the panel 210, can be used as an area in which a product 90 may be replaced after being initially removed by a customer.

Here, unlike the embodiment shown in FIGS. 1 and 2, an additional top member 233 is used to provide a top for a portion of chute 224 and which also provides additional structural rigidity to the top portion of panel 210. For structural rigidity and to provide visibility to the product positioned on first and second rails 226 and 228, cut out portions 218 or holes are formed along on panel 210 along the chutes 222 and 224. The cut out portions 218 also allow one to determine the quantity and contents of such chutes thus facilitating inventory control of the products stored therein.

At least one set of positioning elements 236 are formed on the side 212 as raised protrusions having a height normal to the side 212 less than the rails 226, 228 and 232. Each positioning element 238, 240 has a curvilinear configuration which is substantially C-shaped. The first positioning element 238 is disposed between the first and second rails 226, 228. The second positioning element 240 is disposed between the second and third rails 228, 232, for a bottom portion of chute 224, as well as between second rail 228 and top member 233, for a top portion of chute 224.

A plurality of bosses 242, 244, 246 and 248 are formed at each corner of the panel 210, and when used, provide greater rigidity to the multi-chute gravity feed dispenser display. Each has at least one aperture or bore 249 defined therein and a lock 250 associated with each bore 249. The lock mechanism or lock 250 is defined in the boss 242, 244, 246, 248 where a portion of an outer wall of the boss 242, 244, 246, 248 is removed to form a receptacle. Additional bosses 252 and 253 are also included where boss 252 is formed in a generally medial position adjacent an end of the first rail 226 and where boss 253 is generally located near a lower position on panel 210 near the lower extent of second rail 228. At least one bore 249 is defined in both additional bosses 252 and 253. However, such two bosses do not include a lock. Although not shown, an additional retention pin engages the bore 249 defined in the boss 253.

An aperture 254 is formed in the panel 210 disposed between the second positioning element 240 and an upper boss 244 for positioning an access door. A plurality of feet 256 are formed on the side 212 and extend from the third rail 232 to the lower portion edge of the panel 210 in order to provide stability to the panel 210. Each foot 256 extends normal to the side 212 in the same manner as the rails 226, 228 and 232 to the same extent. Unlike the embodiment shown in FIGS. 1 and 2, here an additional stability arm 257 is included for additional structural stability.

As best shown in FIGS. 16 and 18, a blade sign base member 270 is located longitudinally along the upper portion of the panel 210 and extending from a location adjacent to the bottom of upper boss 244 to a location at or adjacent to first rail 226. The blade sign base member 270 has offset grooves 272 for mating with a blade sign display member discussed in greater detail below. The blade sign base member 270 is located in parallel along a substantial portion of its length and having a beginning location 274 at the top 276 of the blade sign base member 270 and ending at an ending location 278 near the bottom 280 of the blade sign base member 270.

Next, FIGS. 19, 20, 21, 22, and 23 show a blade sign display member 400 designed to attach to the blade sign base member 270 of panel 210. The blade sign display member 400 has a clamp section 402, a face section 404 and an outer lip 406. Further, clamp section 402 has a cavity 408 therein. Inside the cavity 408 there are opposing offset ribs or tongues 410 and 412 for mating with the grooves 272 of the blades sign base member 270. The attaching of the blade sign display member 400 to blade sign base member 270 can be achieved in a number of ways.

For example, by aligning the blade sign display member 400 above the sign base member 270 in a linear manner such that the grooves 272 of the blades sign base member 270 are lined up with the tongues 410 and 412, once so aligned, a downward force is then applied on the display member 400 such that the tongues 410 and 412 slide within the grooves 272 until the top of the display member 400 is near the top of blades sign base member 270. Another example is to line up the opening of cavity 408 of blade sign display member 400 along the front edge of blades sign base member 270 such that the top of both the blade sign display member 270 and the display member 400 are located proximate to one another, and such that the cavity 408 is located along the same direction that blades sign base member 270 protrudes from panel 210, and whereupon force is applied down the length of blade sign display member 400 towards its clamp section 402 such that the front of the cavity 408 is forced open to allow the entry of the front edge of the blade sign display member 270 and where force is continually applied until the tongues 410 and 412 snap into engagement with grooves 272.

Further, the face section 404, one on each side of the blade sign display member 400, can contain signage indicating the products or category of products stored in the associated multi-chute gravity feed dispenser display. The signage can be any of a number of advertising mediums such as an adhesive backed material, a plastic, paper or cardboard sheet having tabs that interlock with corresponding apertures on the blade sign display member 400.

Next, FIGS. 24A, 24B, 24C, 24D and 24E show various different views of the access door 570. The access door 570 includes a front face 572, a rear face 573, a handle 574, a clips 576A and 576B, a pair of resilient arms 578 and a pair of alignment arms 580. The front face 572 is configured as slightly curved to present a pleasing appearance and increased surface area for advertising display purposes. The handle 574 is disposed at the top of the access door 570 opposite and enables a user to easily move the access door from a closed position to an open position. Preferably, the access door 570 is moved from a generally vertical orientation in the closed position to a orientation in the open position which is at least horizontal and preferably several degrees past horizontal. Other embodiments allow for the complete or partial removal of access door 570. The resilient arms 578 include an enlarged nub 582 which engages the aperture formed in the side 212. The nub 582 provides a secondary connection for the access door to the panel 210. The clip clips 576A and 576B are the primary connection to the adjacent panels 210. The clips 576A and 576B engage medially disposed retention pin 62 and move relative thereto. Alignment arms 580 engage adjacent panels 210 when necessary in order to maintain the access door properly disposed between adjacent panels 210.

In addition to providing the functionality and the advantages described above, the loading magazine 100 has the additional advantages associated with its use with standard shelving, and other display structures generally known to be used to display products 90, that do not otherwise represent a multi-chute gravity feed dispenser display. Regardless of the type of display structure used to display the products 90, the magazine 100 provides the same secure and easy transportation to the location at which the new products 92 will be displayed as described above. In addition, and in a similar fashion to that described above, the loading magazine 100 provides a convenient and easy way of expelling the contents of a loaded magazine 100 onto a variety of display structures.

Although new product display designs, such as standard gravity fed shelving for example, have provided advances in the area display stocking, many stocking procedures still populate display structures in the same manner that occurred decades ago, i.e., by the placement of new products 92 on such display structures on a unit by unit, or product by product, or can by can basis. However, now with the loading magazine 100 of FIG. 6A, display structures can be instantly loaded with a loading magazine 100 of new products 92, greatly reducing the time and effort associated with the unit by unit shelf populating techniques. For example, in the case of standard shelving, where products are generally placed next to one another in a vertical position, e.g., where cylindrical articles are rested on an end, the loading magazine 100 may positioned on a portion of the standard shelf with the non-porous side 134 resting thereon and then the tear strip 142 may then be partially or fully removed, removing or reducing the securing force or pressure about loading magazine 100 about new product 90, and one may use their hand or other object to push, or hold in place, the new goods 92 within the loading magazine 100, while with their other hand, pulling or grasping the paper overwrap 148 such that the new products 92 populate the standard shelf as an organized group of new products 92 arranged in a column and row format. Other embodiments do not include the maintaining of the organized nature in row and column format as the new product 92 populate the standard shelf, as such embodiments rely more heavily on the advantage of the loading of a group of new products 92 at one time, over the prior art method of stocking such shelving on a unit by unit basis.

Although many of the embodiments described above are limited to the use of two chutes 22 and 24, other embodiments contain the use one, three or more chutes.

Figure 25:
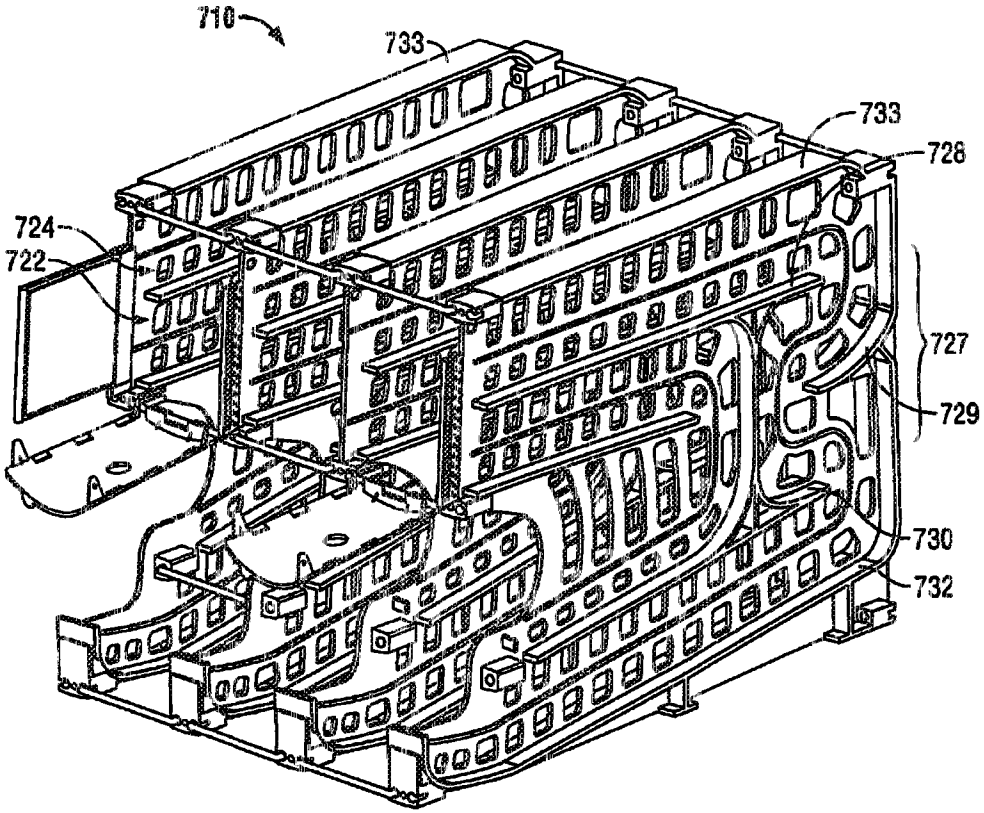
FIG. 25 is a perspective view of a further embodiment of the present invention.
Figure 26:
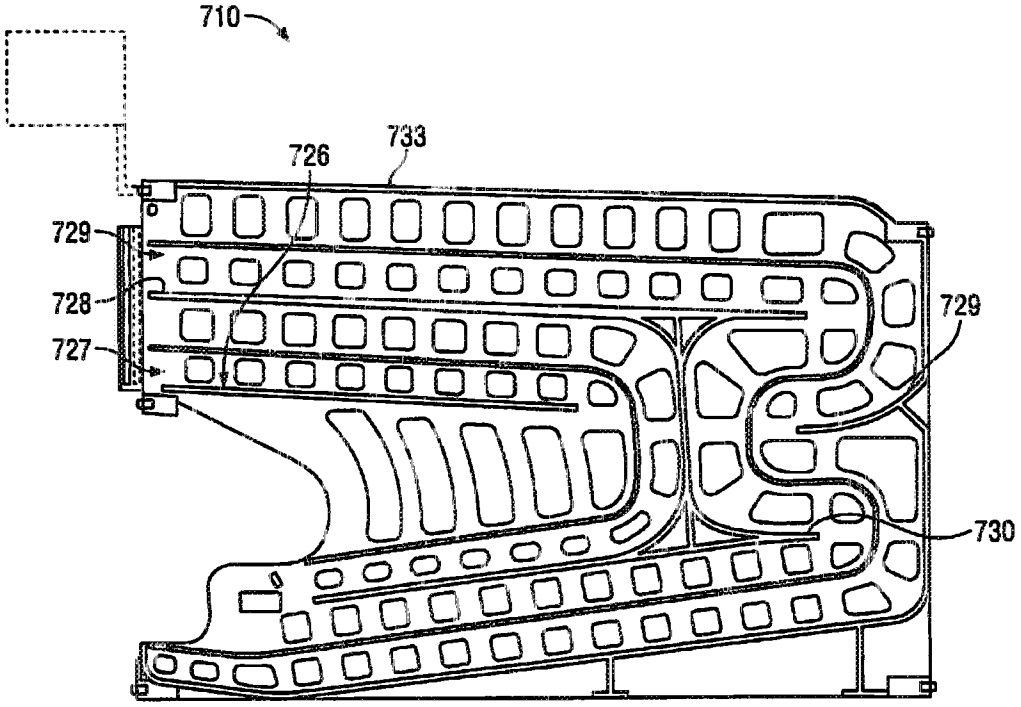
FIG. 26 is a side elevational view of one of the panels of the embodiment of FIG. 25.
Figure 28:
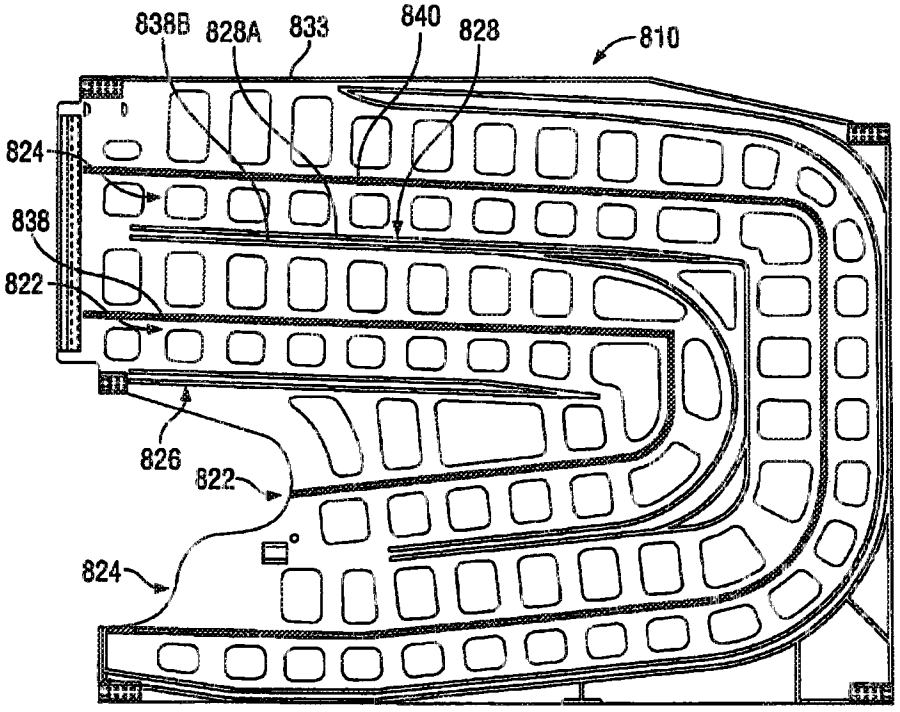
FIG. 28 is a side elevational view of a panel of yet another embodiment of this invention.
Figure 27:
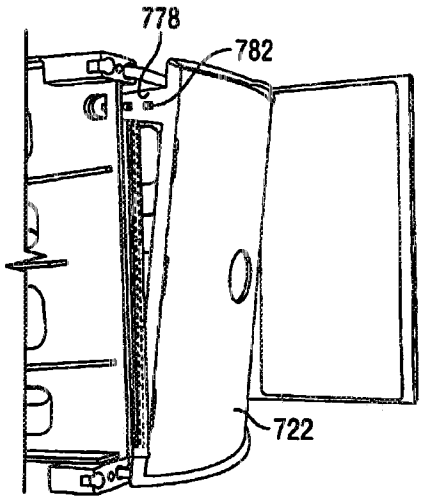
FIG. 27 is a fragmentary perspective view of a modified door assembly.
Figure 29:
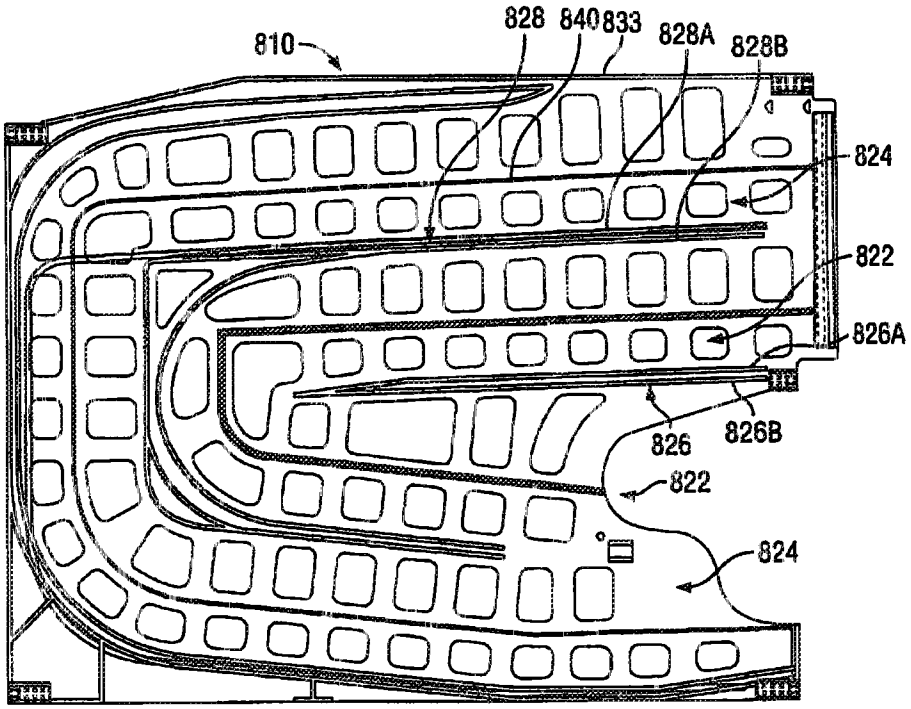
FIG. 29 is a side elevational view of the reverse side of the panel of FIG. 28.
Figure 30:
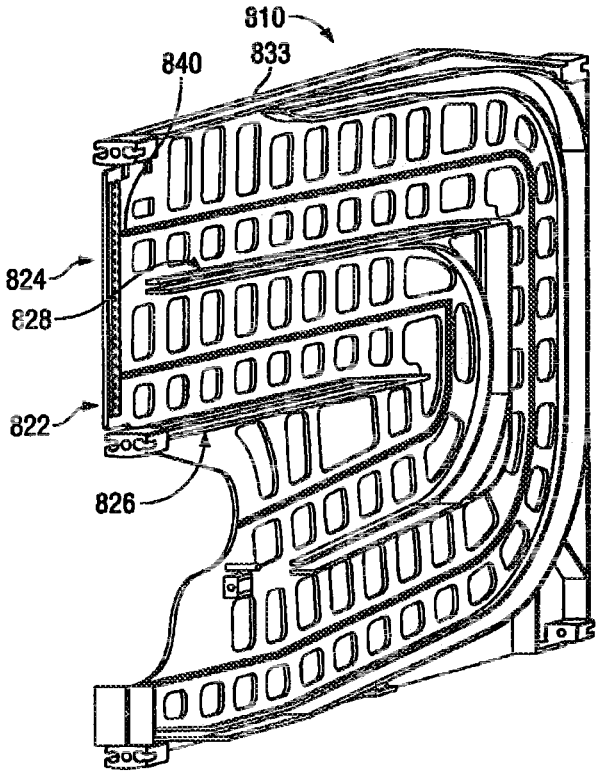
FIG. 30 is a perspective view of the panel of FIGS. 28 and 29.
Figure 31:
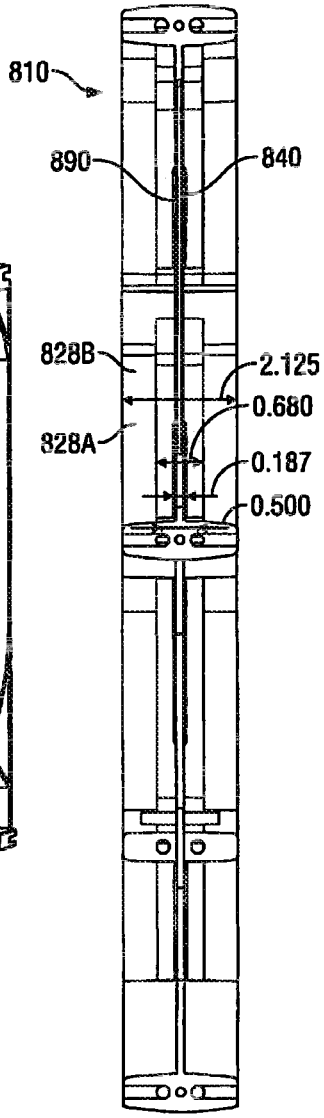
FIG. 31 is an enlarge front elevational view of the panel of FIGS. 28-30.

With reference to FIGS. 25 and 26, there is disclosed an alternative embodiment differs from that of FIGS. 1 and 3A primarily in that the upper loading (and lower dispensing) chute 724 includes a double turn drop region 727 between the upper and lower portion of the chute 724. The embodiment of FIGS. 25 and 26 also include an upper flange 733 to impart greater rigidity to the panel 710. In certain overall size circumstances, for example, deep shelving situations, it has been determined that such chute configuration accommodates a greater number of products. It also enables a reduction of the drop velocity of items transitioning from the upper portion of this chute 724 to the lower portion thereof.

FIG. 7 illustrates a modified door 772 for enabling a tilting orientation thereof to improve visibility of any graphics affixed to the door 772 when the display is disposed on a top shelf. To this end, the resilient arms 778 include a plurality of offset nubs 782.

With reference to FIGS. 28-32, a further embodiment is illustrated wherein the display panels 810 include rail sets 826, 828. As will as discussed, the incorporation of rail sets 826, 828 enables the display 810 to accommodate cylindrical items of differing heights and diameters without requiring any change in lateral spacing between adjacent panels 810.

Figure 32:
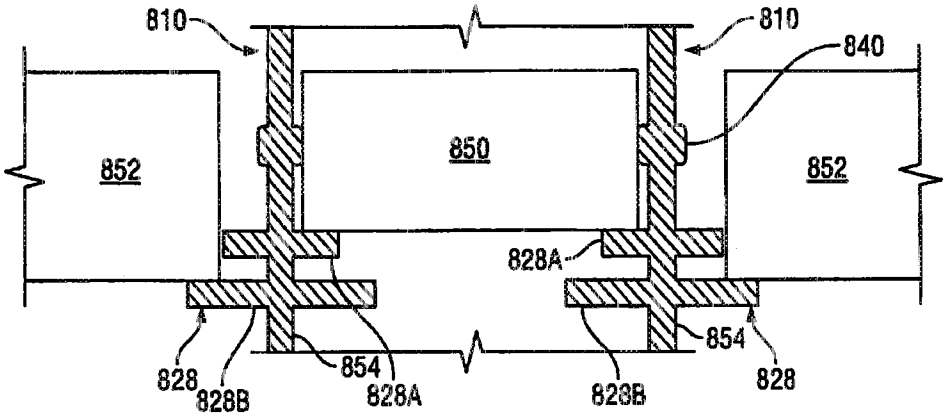
FIG. 32 is an enlarged fragmentary view illustrating the dual rail feature of the embodiment of FIGS. 28-31.

With reference to FIG. 32, a fragmentary view, which illustrates rail sets 828 of adjacent panels 810, each set 828 includes a first or upper rail 828A and a second or lower rail 828B, the first and second rails 828A and 828B being vertically offset in spaced relation. With this configuration of rails, a cylindrical item 850 having a height H1 will engage the upper rails 828A of rail sets 828 of adjacent of the display panels 810 while cylindrical items 852 having a height H2 that is less than H1 engage the lower rails 828B of rail sets 828.

It will be appreciated that The free edge of the first or upper rails 828A serve the same function for cylindrical items 852 as the positioning elements 840 do for cylindrical items 850.

In one specific embodiment the panels are made of high impact polystyrene. The vertical panel walls 854 each have a thickness of 0.130 inch, have a height of 15.75 inches and a depth of 20 inches. The first or upper rail 828A has a total width (free end to free end) of 0.680 inch so that it projects 0.275 inch and has a rail chute width of 0.275 inch. The total width (free end to free end) of the second or lower rail 828B is 2.125 inches so that it projects about 1.0 inch and has a rail chute width of 1.0 inch. The free space between the first rail 828A and second rail 828B is 0.125 inch. The free space between adjacent of the display panels 810 is 5.031 inches. This specific embodiment is capable of storing and dispensing cylindrical items having heights ranging from about 5 inches to about 4.2 inches such that the same display modules can accommodate cans, for example, soup cans of diverse manufacturers, or the same manufacturer, having different heights. In this regard there are currently popular ready to serve soup cans having heights of 4.98 inches, 4.42 inches and 4.395 inches. Retailers, thus, are able to restock the modules with different products depending on sales promotions and other factors.

As will be apparent to those skilled in the art, an important feature of the modular display is that the loading door can serves as an advertising material mount or as a label holder for product labeling. In certain instances wherein smaller items are to be stored and dispensed thereby requiring that the display panels be relatively closely spaced, a single loading door may be used for adjacent modules so that larger graphics may be affixed thereto.

What is claimed is:

1. A display device for generally cylindrical articles all having substantially equal heights and diameters, said display device comprising:

an upper portion defining a generally forwardly facing loading opening; and a lower portion having first and second forwardly disposed dispensing portions in the display device, the second dispensing portion being vertically positioned above the first dispensing portion;

product support structures supported in the display device and operatively connecting with the first and second dispensing portions;

said product support structures communicating with the forwardly facing loading opening so that the generally cylindrical articles when loaded into the forward facing loading opening proceed to the product support structures and travel thereon with an axis of the articles being generally horizontal, said product support structures being configured so that the generally cylindrical articles advance thereon by gravity towards the first or second dispensing portions;

the first and second dispensing portions having, respectively, first and second product travel stops supported thereon, the travel stops each being configured to block forward motion of the cylindrical articles in the respective dispensing portion beyond a respective forwardmost point; and the first and second dispensing portions defining therebetween a generally upwardly-disposed space extending a horizontal distance between a forwardmost end portion of the second dispensing portion and the forwardmost point of the first product travel stop; and the second dispensing portion being supported at a vertical distance above the product support structure leading to the first dispensing portion so as to define a product passage space therebetween that is configured to allow passage of the cylindrical articles therethrough;

said horizontal distance being greater than said vertical distance.

2. A display device according to claim 1, and further comprising a pair of panels positioned laterally at a distance from each other and supporting the product support structures therebetween;

an access door with a width that is not laterally wider than the pair of laterally spaced panels and having a forward surface displaying information relating to the generally cylindrical articles and being supported for movement between a closed position and an open position;

in the closed position, said access door being vertical and covering the forward facing loading opening; and in the open position, said access door being positioned sufficiently away from the forward facing opening so as to permit loading of the generally cylindrical articles into the forward facing loading opening.

3. A display device according to claim 2, wherein the forward surface of the access door is curved convexly forward.

4. A display device according to claim 2, wherein the access door is supported on the display device so as to pivot about an axis between the open and closed positions thereof.

5. A display device according to claim 4, wherein the axis is generally horizontal and adjacent a lower end of the access door in the closed position.

6. A display device according to claim 5, wherein and the access door pivots at least 90 degrees thereabout in moving from the closed position to the open position.

7. A display device according to claim 6, wherein the forward surface of the access door is curved convexly forward.

8. A display device according to claim 2, wherein the forwardmost end portion of the second dispensing portion is located rearward of the loading opening in the display device, and the laterally spaced panels have rearward recesses therein extending rearwards from the access door at least as far as the forwardmost end portion of the second dispensing portion.

9. A display device according to claim 2, wherein the product support structures include rails extending inwardly from said panels.

10. A display device according to claim 2, wherein the second dispensing portion has a dispensing space above the second product travel stop that is configured to permit the cylindrical articles to pass therethrough, and that extends up to a lower end of the access door.

11. A display device according to claim 10, wherein the product support structures each include first product support structures in the upper portion extending slopingly rearwardly and downwardly from the loading opening and configured to support said articles when loaded through the loading opening to roll rearwardly thereon, and second product support structures in the lower portion of the display device extending slopingly downwardly and forwardly toward the dispensing portions.

12. A display device according to claim 11, wherein the product support structures extend inwardly from said side panels in the display device, and protrusion elements extend inwardly from the panels above the product support structures, said protrusion elements being configured to engage the ends of the cylindrical articles when rolling on the product support structures.

13. A display device according to claim 12, wherein the product support structures comprise pairs of rail portions each extending inwardly from a respective one of the panels.

14. A display device according to claim 1, wherein the forward facing loading opening is vertically oriented, and the product support structures include loading portions each extending rearwardly from a respective vertical part of the vertical loading opening.

15. A display device according to claim 2, wherein the panels have apertures therein configured so that some of the articles in the display device may be seen through said apertures.

* * * * *